US010479088B2

(12) United States Patent
Sasaki et al.

(10) Patent No.: US 10,479,088 B2
(45) Date of Patent: Nov. 19, 2019

(54) INKJET PRINTING APPARATUS

(71) Applicant: CANON KABUSHIKI KAISHA, Tokyo (JP)

(72) Inventors: Takashi Sasaki, Yokohama (JP); Takahiro Kiuchi, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,034

(22) Filed: Jun. 29, 2018

(65) Prior Publication Data

US 2019/0009547 A1 Jan. 10, 2019

(30) Foreign Application Priority Data

Jul. 7, 2017 (JP) ..... 2017-133656

(51) Int. Cl.
*B41J 2/14* (2006.01)
*B41J 2/165* (2006.01)
*B41J 2/155* (2006.01)

(52) U.S. Cl.
CPC ..... *B41J 2/1652* (2013.01); *B41J 2/1433* (2013.01); *B41J 2/155* (2013.01); *B41J 2/16508* (2013.01); *B41J 2/16523* (2013.01); *B41J 2/16526* (2013.01); *B41J 2/16532* (2013.01); *B41J 2/16535* (2013.01); *B41J 2/16538* (2013.01);

(Continued)

(58) Field of Classification Search
CPC ..... B41J 2/1433; B41J 2/155; B41J 2/16508; B41J 2/16523; B41J 2/16526; B41J 2/141; B41J 2/1652; B41J 2/16538; B41J 2/16535; B41J 2202/20
See application file for complete search history.

(56) References Cited

U.S. PATENT DOCUMENTS 7,150,519 B2 12/2006 Kono et al.
7,914,120 B2 * 3/2011 Silverbrook ..... B41J 2/14 347/49

(Continued)

FOREIGN PATENT DOCUMENTS

JP 2011104864 A 6/2011

OTHER PUBLICATIONS

Copending, unpublished U.S. Appl. No. 15/955,005 to Takahiro Kiuchi, et al., filed Apr. 17, 2018.

(Continued)

*Primary Examiner* — Anh T Vo
(74) *Attorney, Agent, or Firm* — Venable LLP

(57) ABSTRACT

An inkjet printing apparatus includes: a printing head provided with ejection units in each of which ejection port arrays are formed, the ejection units being provided along a first direction; and a suction unit capable of contacting the ejection units and sucking the ejection units while moving relative to the ejection units. A contact region of the suction unit with each of the ejection units does not cover a corner portion among two corner portions of a second ejection unit located at opposite ends of a first end edge thereof on an upstream in a direction of movement, the corner portion being present at a position not overlapping with a second end edge of a first ejection unit on a downstream in the direction of movement when viewed from the direction of movement, the first ejection unit being provided upstream of the second ejection unit in the direction of movement.

8 Claims, 15 Drawing Sheets

(52) U.S. Cl.
CPC ..... *B41J 2/16541* (2013.01); *B41J 2202/20* (2013.01)

(56) References Cited

U.S. PATENT DOCUMENTS

| | | | | |
|---|---|---|---|---|
| 9,242,470 | B2 | 1/2016 | Suzuki et al. | |
| 2009/0015625 | A1* | 1/2009 | Sumida | B41J 2/16508 347/30 |

OTHER PUBLICATIONS

Copending, unpublished U.S. Appl. No. 15/955,813 to Hiroshi Nakai, et al., filed Apr. 18, 2018.

* cited by examiner

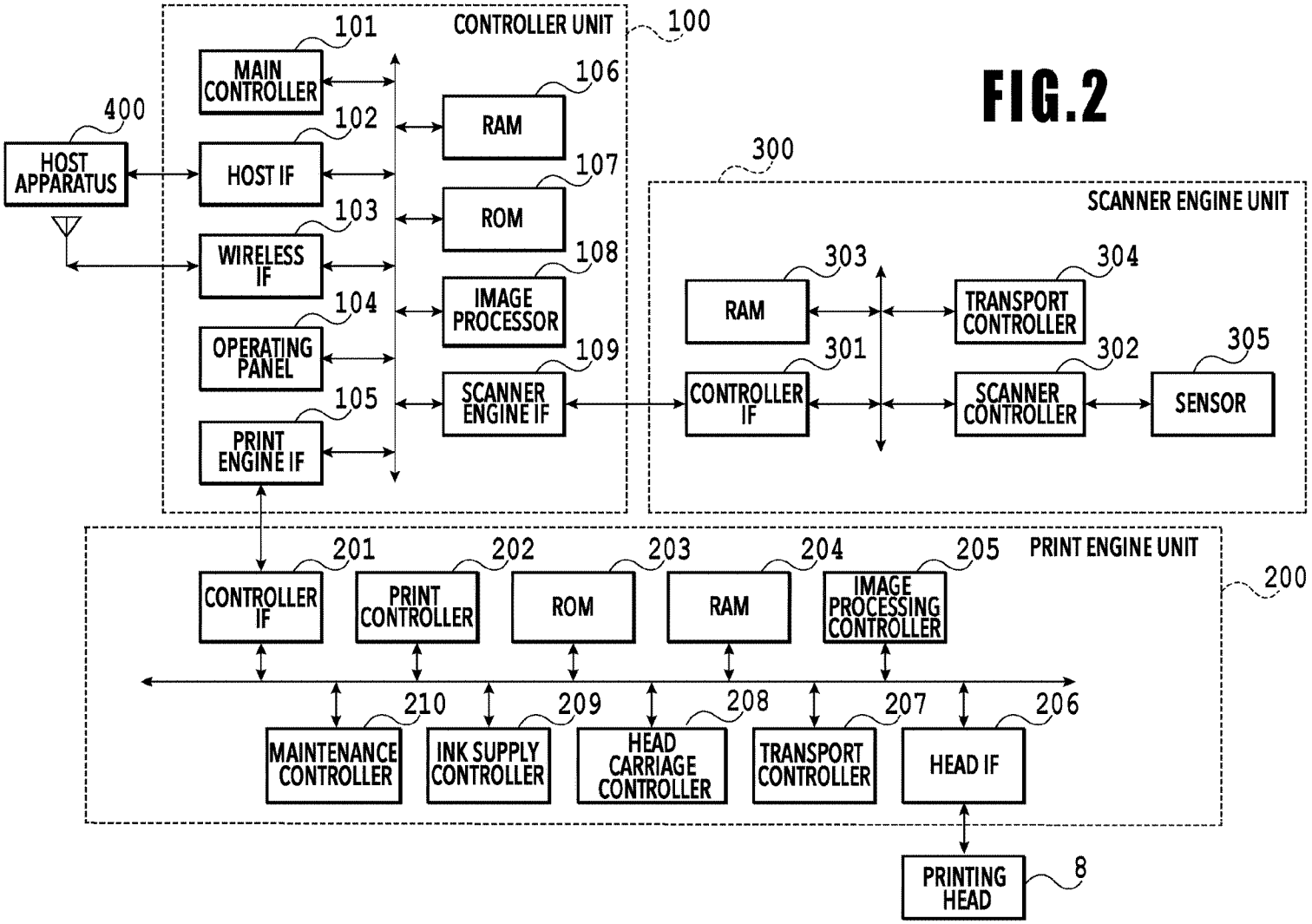
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSOR
108
SCANNER ENGINE IF
109
HOST APPARATUS
400
SCANNER ENGINE UNIT
300
RAM
303
CONTROLLER IF
301
TRANSPORT CONTROLLER
304
SCANNER CONTROLLER
302
SENSOR
305
PRINT ENGINE UNIT
200
CONTROLLER IF
201
PRINT CONTROLLER
202
ROM
203
RAM
204
IMAGE PROCESSING CONTROLLER
205
MAINTENANCE CONTROLLER
210
INK SUPPLY CONTROLLER
209
HEAD CARRIAGE CONTROLLER
208
TRANSPORT CONTROLLER
207
HEAD IF
206
PRINTING HEAD
8

INKJET PRINTING APPARATUS

BACKGROUND OF THE INVENTION

Field of the Invention

The present invention relates to an inkjet printing apparatus including a printing head that prints an image by ejecting ink.

Description of the Related Art

Japanese Patent Laid-Open No. 2011-104864 discloses a technique in which a cleaning process for maintaining and recovering the condition of ink ejection from the ejection ports of ejection units arranged in a staggered pattern is performed by moving a suction part in contact with the ejection units in the direction in which the ejection units are aligned and thereby wiping and sucking the ejection units.

In the technique described in Japanese Patent Laid-Open No. 2011-104864, each of the ejection units, arranged in the staggered pattern, includes sealing portions formed at its opposite end edges with which the suction part comes into contact as it moves. Here, in a case where ejection units of a predetermined shape are disposed next to each other in the printing head, end edges of the adjacent ejection units are in contact with or in vicinity of each other, and therefore sealing portions that seal wirings and the like are provided at edges other than the end edges of the ejection units. Thus, each ejection unit is disposed with its corner portion exposed on the upstream side in the direction of movement of the suction part. Consequently, in the cleaning process, the suction part contacts each ejection unit from the exposed corner portion on the upstream side in the direction of movement. This makes the suction part prone to be damaged at the contact point with this corner portion and deteriorates the durability of the suction part.

SUMMARY OF THE INVENTION

The present invention has been made in view of the above problem and an object thereof is to provide an inkjet printing apparatus capable of suppressing deterioration in durability of a suction unit.

In the first aspect of the present invention, there is provided an inkjet printing apparatus comprising: a printing head provided with a plurality of ejection units in each of which a plurality of ejection port arrays are formed, a plurality of ejection ports for ejecting an ink being aligned in each of the plurality of ejection port arrays, the plurality of ejection units being provided along a first direction with end edges thereof disposed next to each other; and a suction unit capable of contacting the ejection units and sucking the ejection units while moving relative to the ejection units in the first direction, wherein when the suction unit moves in the first direction, after having sucked ink from a first ejection unit, the suction unit sucks ink from a second ejection unit, wherein a contact region of the suction unit with each of the ejection units does not cover a corner portion among two corner portions of the second ejection unit located at opposite ends of a second end edge thereof on an upstream side in a direction of movement of the suction unit, the corner portion being present at a position not overlapping a first end edge of the first ejection unit on a downstream side in the direction of movement when viewed from the direction of movement.

With the present invention, it is possible to suppress deterioration in durability of a suction unit.

Further features of the present invention will become apparent from the following description of exemplary embodiments with reference to the attached drawings.

BRIEF DESCRIPTION OF THE DRAWINGS

FIG. 2 is a diagram of a control configuration of the printing apparatus;

DESCRIPTION OF THE EMBODIMENTS

Figure 1:
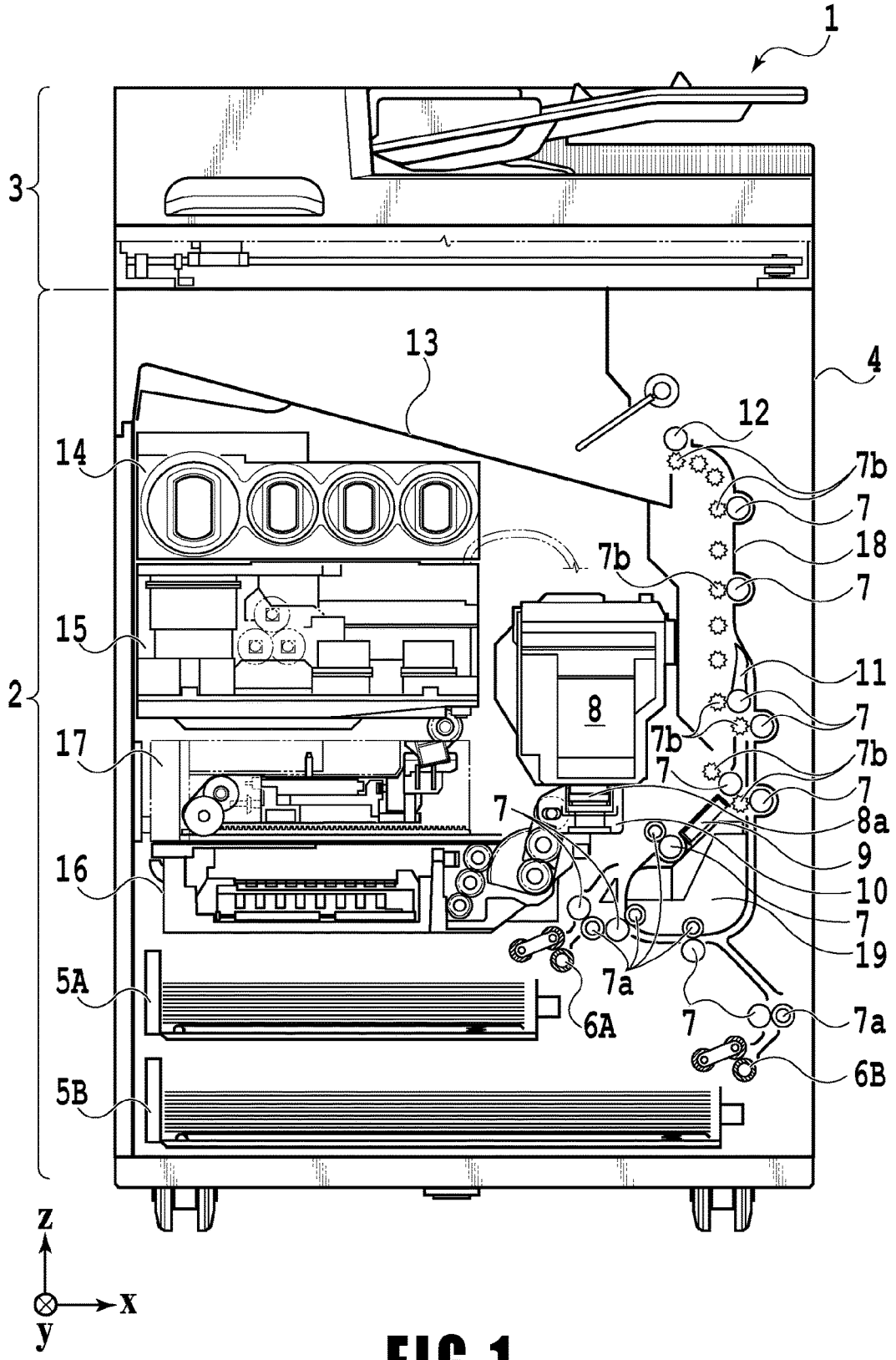
FIG. 1 is a view of a printing apparatus in a standby state.

FIG. 1 is a view of the internal configuration of an inkjet printing apparatus 1 (hereinafter, the printing apparatus 1) used in this embodiment. In FIG. 1, an x direction represents a horizontal direction, a y direction (direction normal to the sheet surface) represents a direction in which ejection ports are aligned in a later-described printing head 8, and a z direction represents the vertical direction.

The printing apparatus 1 is a multi-function peripheral including a print section 2 and a scanner section 3 and can perform various processes related to print operations and read operations with the print section 2 and the scanner section 3 individually or in combination with each other. The scanner section 3 includes an automatic document feeder (ADF) and a flatbed scanner (FBS) and can read a document automatically fed by the ADF and read (scan) a document placed on the FBS' document table by the user. Note that although the printing apparatus 1 is a multi-function peripheral including the print section 2 and the scanner section 3 in this embodiment, the printing apparatus 1 may be of a type without the scanner section 3. FIG. 1 illustrates the printing apparatus 1 in a standby state in which it is performing no print operation or read operation.

A first cassette 5A and a second cassette 5B that house print media (cut sheets) S are mounted in an attachable and detachable manner at a bottom portion of the print section 2 on the lower side of a housing 4 in the vertical direction. The first cassette 5A houses relatively small print media of up to a size of A4 in the form of a flat pile. The second cassette 5B houses relatively large print media of a size of up to A3 in the form of a flat pile. Near the first cassette 5A, a first feed unit 6A is provided which separately feeds the housed print media. Likewise, a second feed unit 6B is provided near the second cassette 5B. When a print operation is performed, a print medium S is fed selectively from one of the cassettes.

Transport rollers 7, a discharge roller 12, pinch rollers 7*a*, spurs 7*b*, a guide 18, an inner guide 19, and a flapper 11 are transport mechanisms that guide print media S in predetermined directions. The transport rollers 7 are drive rollers disposed upstream and downstream of the printing head 8 and driven by a transport motor not illustrated. The pinch rollers 7*a* are driven rollers that rotate while nipping a print medium S with the transport rollers 7. The discharge roller 12 is a drive roller disposed downstream of the transport rollers 7 and driven by a transport motor not illustrated. The spurs 7*b* transport a print medium S while holding it between themselves and the transport rollers 7 disposed downstream of the printing head 8 and the discharge roller 12.

The guide 18 is provided along a transport path for print media S and guides a print medium S in predetermined directions. The inner guide 19 is a member extending in the y direction and having a curved side surface and guides a print medium S along this side surface. The flapper 11 is a member that switches the direction of transport of a print medium S in a double-sided print operation. A discharge tray 13 is a tray on which to place and hold print media S discharged by the discharge roller 12 after completing their print operations.

The printing head 8 in this embodiment is a full line-type color inkjet printing head, in which a plurality of ejection ports for ejecting inks according to print data are aligned along the y direction in FIG. 1, the number of ejection ports corresponding to the width of the print media S. When the printing head 8 is at a standby position, an ejection port surface 8*a* of the printing head 8 faces downward in a gravitational direction and is covered by a cap unit 10, as illustrated in FIG. 1. When a print operation is performed, a later-described print controller 202 changes the orientation of the printing head 8 such that the ejection port surface 8*a* faces a platen 9. The platen 9 is made of a flat plate extending in the y direction and supports the back surface of a print medium S on which a print operation is to be performed by the printing head 8. Movement of the printing head 8 from the standby position to a print position will be described later in detail.

An ink tank unit 14 stores inks of four colors to be supplied to the printing head 8. An ink supply unit 15 is provided at a point along a flow channel connecting the ink tank unit 14 and the printing head 8 and adjusts the pressure and flow rate of the inks inside the printing head 8 within appropriate ranges. This embodiment employs a circulatory ink feed system. The ink supply unit 15 adjusts the pressure of the inks to be supplied to the printing head 8 and the flow rate of the inks collected from the printing head 8 within appropriate ranges.

A maintenance unit 16 includes the cap unit 10 and a wiping unit 17 and operates them with a predetermined timing to perform a maintenance operation on the printing head 8. The maintenance operation will be described later in detail.

FIG. 2 is a block diagram illustrating a control configuration in the printing apparatus 1. The control configuration mainly includes a print engine unit 200 that controls the print section 2, a scanner engine unit 300 that controls the scanner section 3, and a controller unit 100 that controls the whole printing apparatus 1. The print controller 202 controls various mechanisms of the print engine unit 200 in accordance with instructions from a main controller 101 of the controller unit 100. Various mechanisms of the scanner engine unit 300 are controlled by the main controller 101 of the controller unit 100. Details of the control configuration will be described below.

In the controller unit 100, the main controller 101, configured of a CPU, controls the entire printing apparatus 1 by using an RAM 106 as a work area in accordance with programs and various parameters stored in an ROM 107. For example, upon input of a print job from a host apparatus 400 through a host I/F 102 or a wireless I/F 103, an image processor 108 performs predetermined image processing on received image data in accordance with an instruction from the main controller 101. The main controller 101 then transmits the image data after the image processing to the print engine unit 200 through a print engine I/F 105.

Meanwhile, the printing apparatus 1 may obtain image data from the host apparatus 400 by means of wireless communication or wired communication or from an external storage device (such as a USB memory) connected to the printing apparatus 1. The communication method used for the wireless communication or the wired communication is not particularly limited. For example, Wireless Fidelity (Wi-Fi) (registered trademark) or Bluetooth (registered trademark) can be employed as the communication method used for the wireless communication. Also, universal serial bus (USB) or the like can be employed as the communication method used for the wired communication. Further, for example, upon input of a read command from the host apparatus 400, the main controller 101 transmits this command to the scanner section 3 through a scanner engine I/F 109.

An operation panel 104 is a mechanism with which the user inputs and receives information into and from the printing apparatus 1. Through the operation panel 104, the user can instruct the controller unit 100 to perform operations such as photocopying and scanning, set a print mode, check information on the printing apparatus 1, and so on.

In the print engine unit 200, the print controller 202, configured of a CPU, controls various mechanisms of the print section 2 by using an RAM 204 as a work area in accordance with programs and various parameters stored in an ROM 203. Upon receipt of various commands and image data through a controller I/F 201, the print controller 202 temporarily stores them in an RAM 204. The print controller 202 causes an image processing controller 205 to convert the stored image data into print data so that the printing head 8 can use the stored image data in a print operation. After the print data is generated, the print controller 202 causes the printing head 8 to perform a print operation based on the print data through a head I/F 206. In doing so, the print controller 202 transports a print medium S by driving the feed unit 6A or 6B, the transport rollers 7, the discharge roller 12, and the flapper 11, which are illustrated in FIG. 1, through a transport controller 207. A print process is performed by performing a print operation with the printing head 8 in combination with the operation of transporting the print medium S in accordance with instructions from the print controller 202.

A head carriage controller 208 changes the orientation and position of the printing head 8 in accordance with the operation state of the printing apparatus 1 such as a maintenance state or a print state. An ink supply controller 209 controls the ink supply unit 15 such that the pressure of the inks to be supplied to the printing head 8 fall within an appropriate range. A maintenance controller 210 controls the operation of the cap unit 10 and the wiping unit 17 of the maintenance unit 16 when a maintenance operation is performed on the printing head 8.

For the scanner engine unit 300, the main controller 101 controls hardware resources in a scanner controller 302 by using the RAM 106 as a work area in accordance with programs and various parameters stored in the ROM 107. As a result, various mechanisms of the scanner section 3 are controlled. For example, the main controller 101 controls hardware resources in the scanner controller 302 through a controller I/F 301 such that a document loaded on the ADF by the user is transported through a transport controller 304 and read by a sensor 305. Then, the scanner controller 302 stores the read image data in an RAM 303. Meanwhile, by converting the image data thus obtained into print data, the print controller 202 can cause the printing head 8 to perform a print operation based on the image data read by the scanner controller 302.

Figure 3:
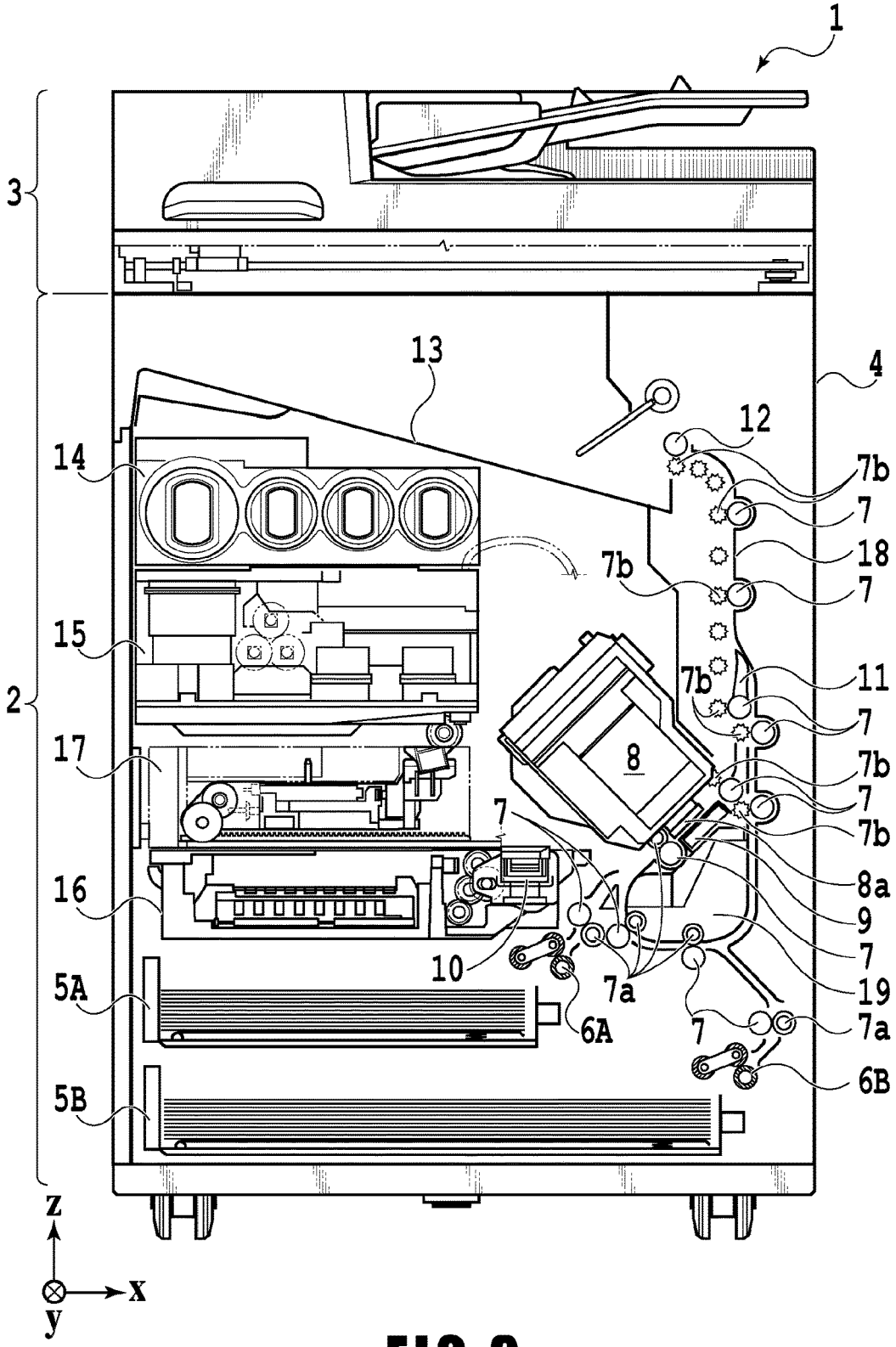
FIG. 3 is a view of the printing apparatus in a print state.

FIG. 3 illustrates the printing apparatus 1 in a print state. In contrast to the standby state illustrated in FIG. 1, the cap unit 10 is separated from the ejection port surface 8*a* of the printing head 8, and the ejection port surface 8*a* is facing the platen 9. In this embodiment, the plane of the platen 9 is tilted at approximate 45 degrees with respect to the horizontal direction, and the ejection port surface 8*a* of the printing head 8 at the print position is also tilted at approximately 45 degrees with respect to the horizontal direction so that the distance between the ejection port surface 8*a* and the platen 9 can be kept at a fixed distance.

When the printing head 8 is moved from the standby position illustrated in FIG. 1 to the print position illustrated in FIG. 3, the print controller 202 lowers the cap unit 10 to a retreat position illustrated in FIG. 3 by using the maintenance controller 210. As a result, the ejection port surface 8*a* of the printing head 8 is separated from a cap member 10*a*. Then, using the head carriage controller 208, the print controller 202 turns the printing head 8 by 45 degrees while adjusting its height level in the vertical direction, to thereby make the ejection port surface 8*a* face the platen 9. The print controller 202 performs the reverse of the above steps when moving the printing head 8 from the print position to the standby position after a print operation is completed.

Next, the transport paths for print media S in the print section 2 will be described. Upon input of a print command, the print controller 202 firstly moves the printing head 8 to the print position illustrated in FIG. 3 by using the maintenance controller 210 and the head carriage controller 208. The print controller 202 then drives the first feed unit 6A or the second feed unit 6B based on the print command and feeds a print medium S by using the transport controller 207.

Figure 4C:
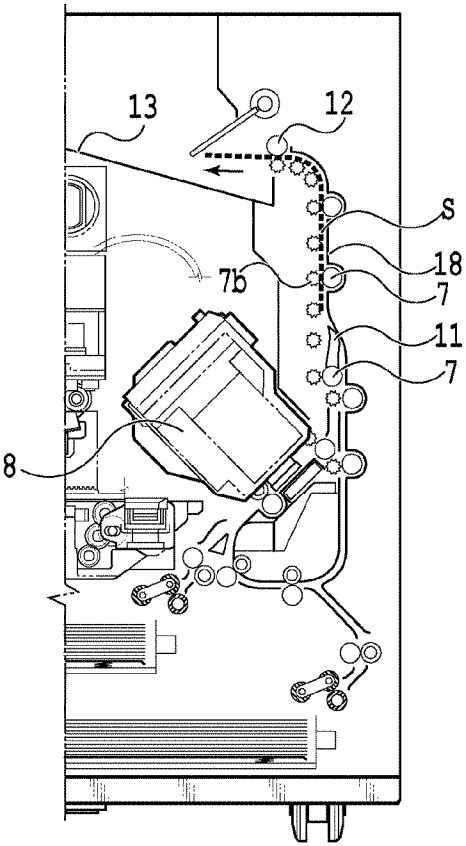
FIG. 4A, FIG. 4B, and FIG. 4C are views of a transport path of a print medium fed from a first cassette.
Figure 4B:
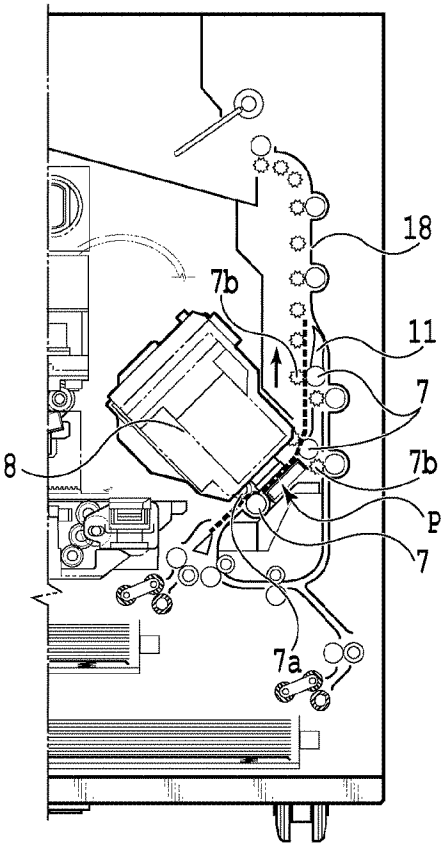
Figure 4A:
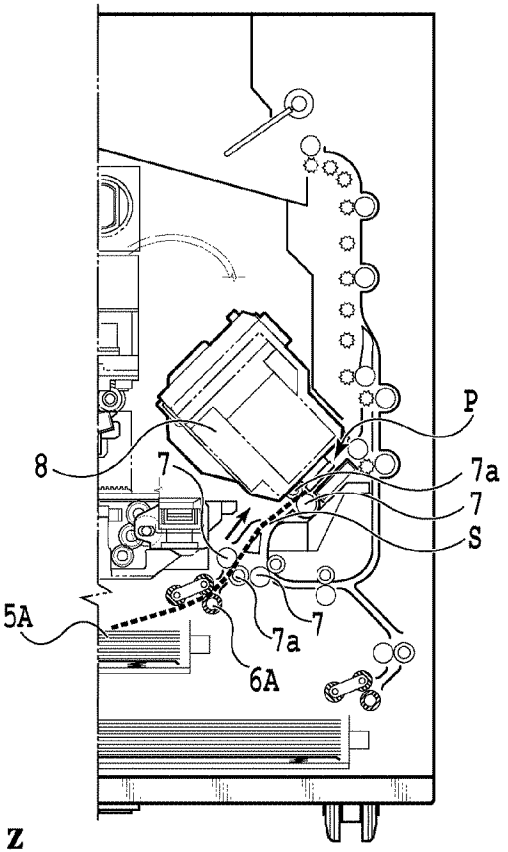

FIG. 4A, FIG. 4B, and FIG. 4C are views illustrating a transport path used in a case of feeding an A4 print medium S stored in the first cassette 5A. The print medium S stacked at the top in the first cassette 5A is separated from the second and lower print media by the first feed unit 6A and transported toward a printing region P between the platen 9 and the printing head 8 while being nipped between some transport rollers 7 and pinch rollers 7*a*. FIG. 4A illustrates a transport state immediately before the leading edge of the print medium S reaches the printing region P. The direction of travel of the print medium S is changed from the horizontal direction (x direction) to a direction tilted at approximately 45 degrees with respect to the horizontal direction by the time the print medium S reaches the printing region P after being fed by the first feed unit 6A.

At the printing region P, the inks are ejected toward the print medium S from the plurality of ejection ports provided in the printing head 8. The platen 9 supports the back surface of the region of the print medium S to which the inks are to be applied, and the distance between the ejection port surface 8*a* and the print medium S is kept at a fixed distance. After the inks are applied, the print medium S passes the left side of the flapper 11, whose tip is tilted toward the right side, and is transported upward in the vertical direction of the printing apparatus 1 along the guide 18 while being guided by some transport rollers 7 and spurs 7*b*. FIG. 4B illustrates a state where the leading edge of the print medium S has passed the printing region P and is being transported upward in the vertical direction. The direction of travel of the print medium S has been changed to the vertically upward direction by the transport rollers 7 and spurs 7*b* from the position of the printing region P, which is tilted at approximately 45 degrees with respect to the horizontal direction.

After being transported vertically upward, the print medium S is discharged onto the discharge tray 13 by the discharge roller 12 and the spur 7*b*. FIG. 4C illustrates a state where the leading edge of the print medium S has passed the discharge roller 12 and is being discharged onto the discharge tray 13. The print medium S after being discharged is held on the discharge tray 13 in a state where its surface on which the image was printed by the printing head 8 faces down.

Figure 5C:
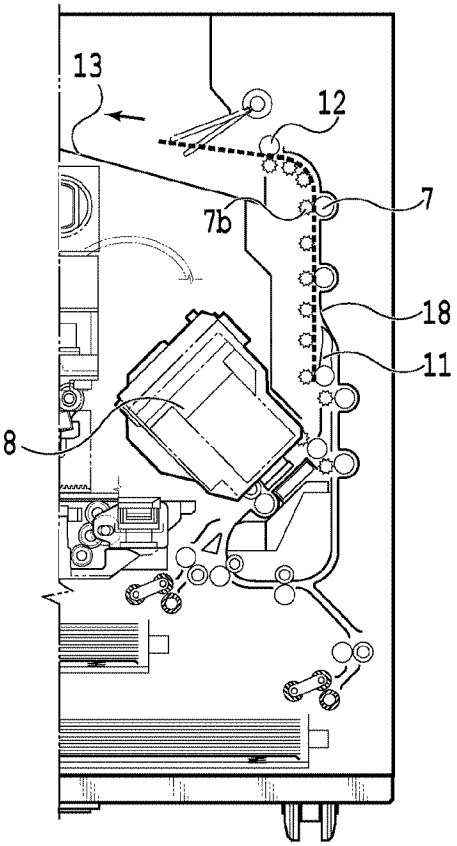
FIG. 5A, FIG. 5B, and FIG. 5C are views of a transport path of a print medium fed from a second cassette.
Figure 5B:
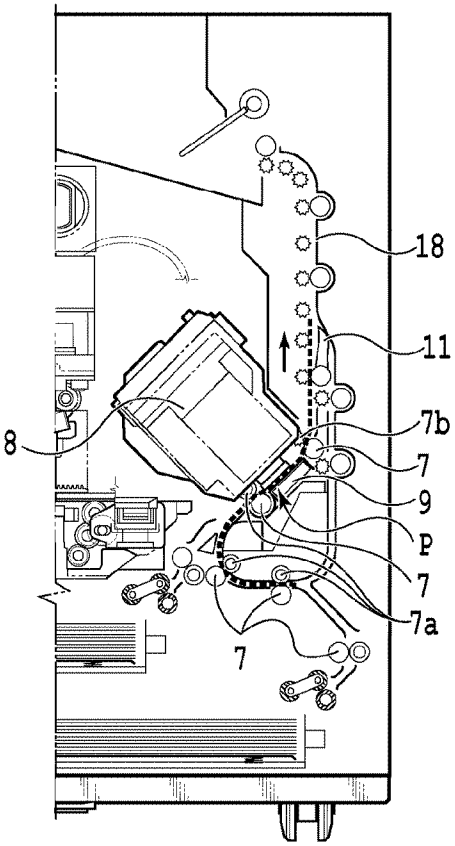
Figure 5A:
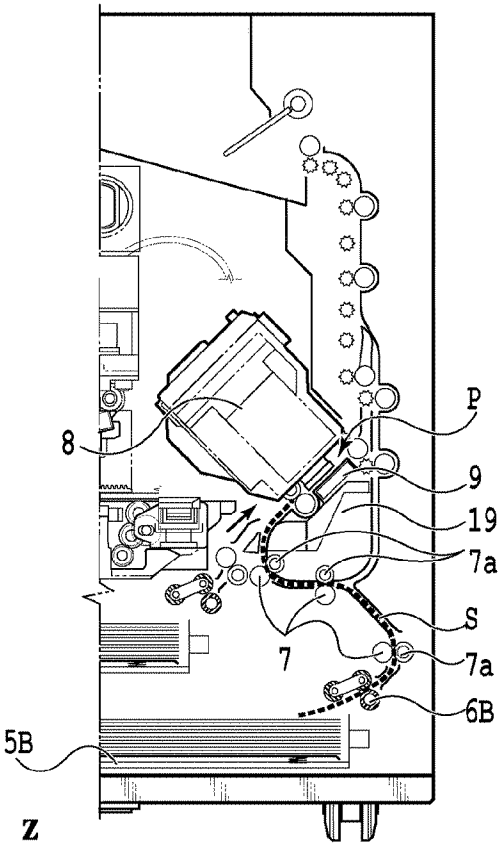

FIG. 5A, FIG. 5B, and FIG. 5C are views illustrating a transport path used in a case of feeding an A3 print medium S stored in the second cassette 5B. The print medium S stacked at the top in the second cassette 5B is separated from the second and lower print media by the second feed unit 6B and transported toward the printing region P between the platen 9 and the printing head 8 while being nipped between some transport rollers 7 and pinch rollers 7*a*.

FIG. 5A illustrates a transport state immediately before the leading edge of the print medium S reaches the printing region P. Pluralities of transport rollers 7 and pinch rollers 7*a* and the inner guide 19 are disposed along the transport path from the point at which the print medium P is fed by the second feed unit 6B to the point at which the print medium P reaches the printing region P. Hence, the print medium P is transported to the platen 9 while being curved in an S-shape.

The subsequent part of the transport path is the same as that in the case with an A4 print medium S illustrated in FIG. 4B and FIG. 4C. FIG. 5B illustrates a state where the leading edge of the print medium S has passed the printing region P and is being transported upward in the vertical direction. FIG. 5C illustrates a state where the leading edge of the print medium S has passed the discharge roller 12 and is being discharged onto the discharge tray 13.

FIG. 6A, FIG. 6B, FIG. 6C, and FIG. 6D illustrate a transport path used in a case of performing a print operation on the back surface (second surface) of an A4 print medium S (double-sided printing). In the case of performing double-sided printing, printing is performed on a first surface (front surface) and thereafter a print operation is performed on a second surface (back surface). The transport steps for performing the first surface printing are the same as FIG. 4A, FIG. 4B, and FIG. 4C and description thereof will therefore be omitted here. The transport steps following FIG. 4C will be described below.

Figures 6A, 6B, 6C, 6D:
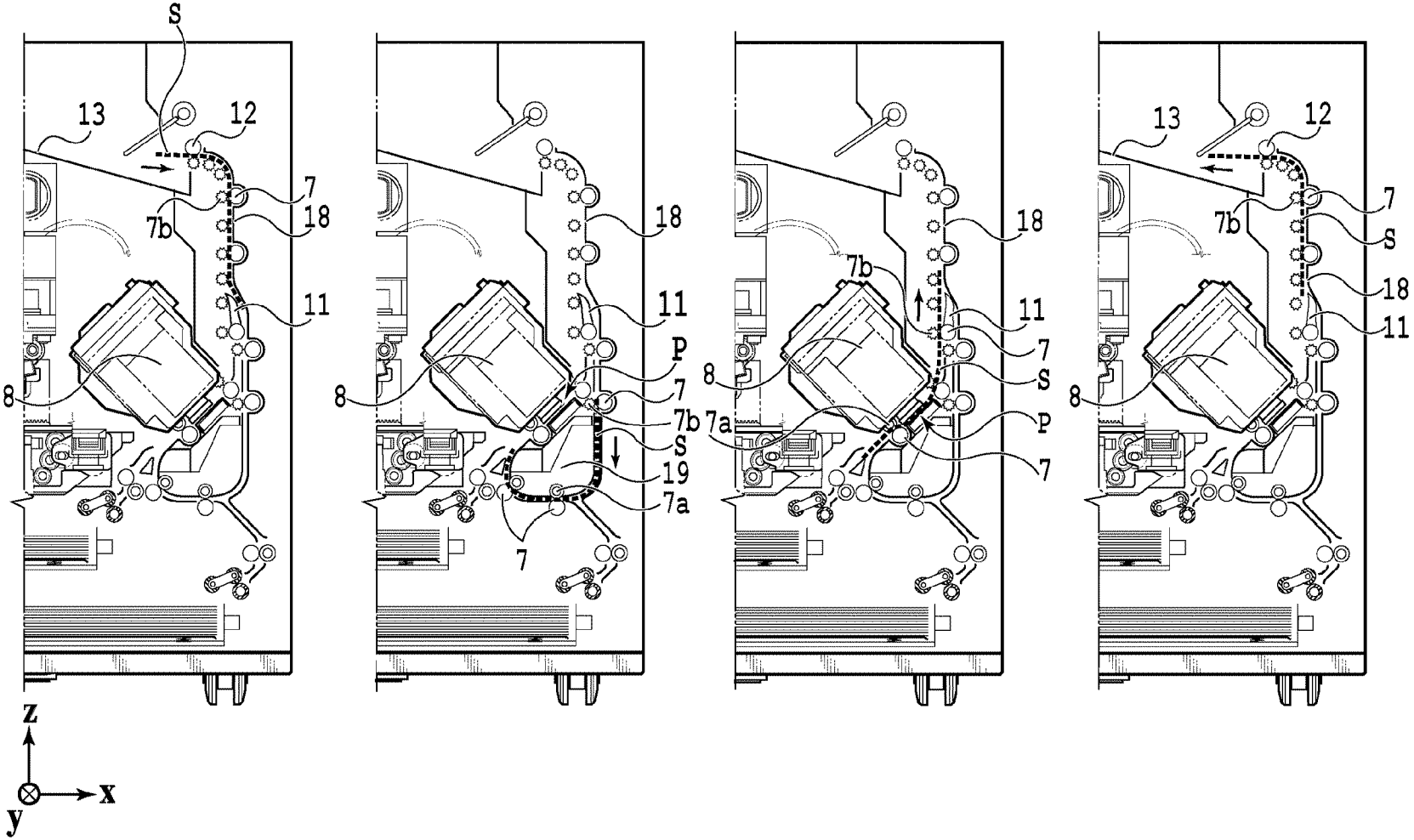
FIG. 6A, FIG. 6B, FIG. 6C, and FIG. 6D are views of views of a transport path used in a case of performing a print operation on the back surface of a print medium.

After the print operation on the first surface by the printing head 8 is completed and the trailing edge of the print medium S passes the flapper 11, the print controller 202 rotates the transport rollers 7 in the opposite direction to thereby transport the print medium S to the inner side of the printing apparatus 1. At this moment, the flapper 11 is controlled by an actuator not illustrated such that its tip is tilted toward the left side. Thus, the leading edge of the print medium S (the trailing edge in the print operation on the first surface) passes the right side of the flapper 11 and is transported downward in the vertical direction. FIG. 6A illustrates a state where the leading edge of the print medium S (the trailing edge in the print operation on the first surface) is passing the right side of the flapper 11.

Thereafter, the print medium S is transported along the curved outer circumferential surface of the inner guide 19 and transported to the printing region P between the printing head 8 and the platen 9 again. This time, the second surface of the print medium S faces the ejection port surface 8*a* of the printing head 8. FIG. 6B illustrates a transport state immediately before the leading edge of the print medium S reaches the printing region P for the print operation on the second surface.

The subsequent part of the transport path is the same as that for the first surface printing illustrated in FIG. 4B and FIG. 4C. FIG. 6C illustrates a state where the leading edge of the print medium S has passed the printing region P and is being transported upward in the vertical direction. At this moment, the flapper 11 is controlled by the actuator not illustrated to move to the position at which its tip is tilted toward the right side. FIG. 6D illustrates a state where the leading edge of the print medium S has passed the discharge roller 12 and is being discharged onto the discharge tray 13.

Next, the maintenance operation on the printing head 8 will be described. As also described with reference to FIG. 1, the maintenance unit 16 in this embodiment includes the cap unit 10 and the wiping unit 17 and operates them with a predetermined timing to perform the maintenance operation.

Figure 7:
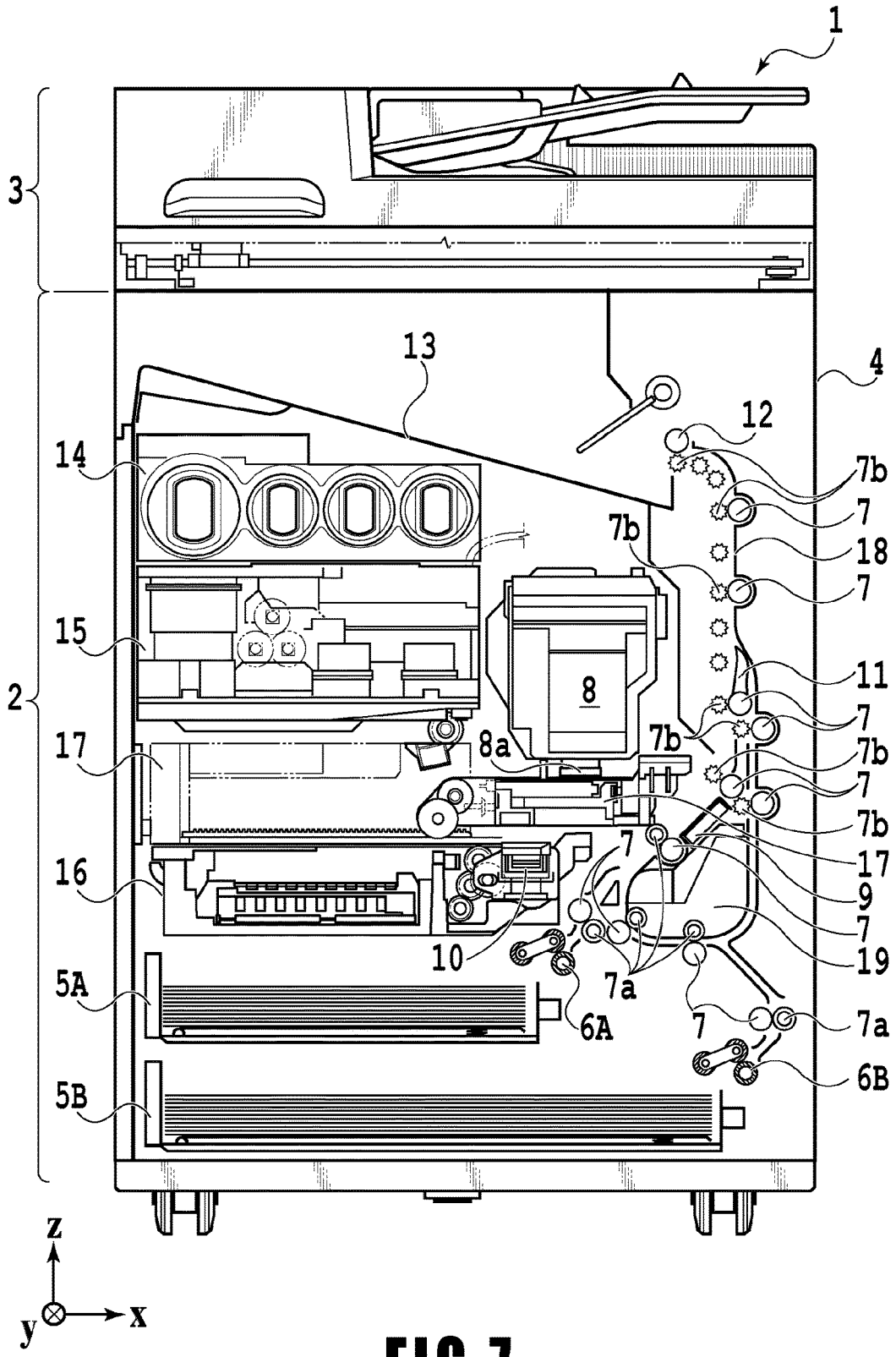
FIG. 7 is a view of the printing apparatus in a maintenance state.

FIG. 7 is a view of the printing apparatus 1 in the maintenance state. To move the printing head 8 from the standby position illustrated in FIG. 1 to a maintenance position illustrated in FIG. 7, the print controller 202 moves the printing head 8 upward in the vertical direction and moves the cap unit 10 downward in the vertical direction. The print controller 202 then moves the wiping unit 17 in the rightward direction in FIG. 7 from its retreat position. The print controller 202 thereafter moves the printing head 8 downward in the vertical direction to thereby move it to the maintenance position, at which the maintenance operation can be performed.

Also, to move the printing head 8 from the print position illustrated in FIG. 3 to the maintenance position illustrated in FIG. 7, the print controller 202 moves the printing head 8 upward in the vertical direction while turning it by 45 degrees. The print controller 202 then moves the wiping unit 17 in the rightward direction from its retreat position. The print controller 202 thereafter moves the printing head 8 downward in the vertical direction to thereby move it to the maintenance position, at which the maintenance operation by the maintenance unit 16 can be performed.

Figure 8A:
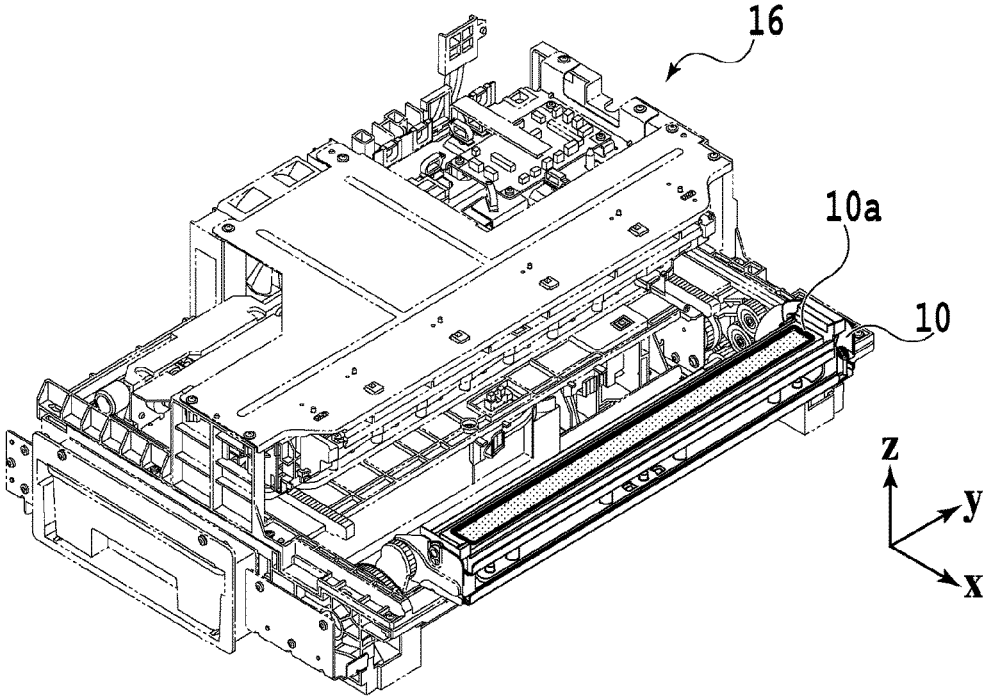
FIG. 8A and FIG. 8B are perspective views illustrating the configuration of a maintenance unit.
Figure 8B:
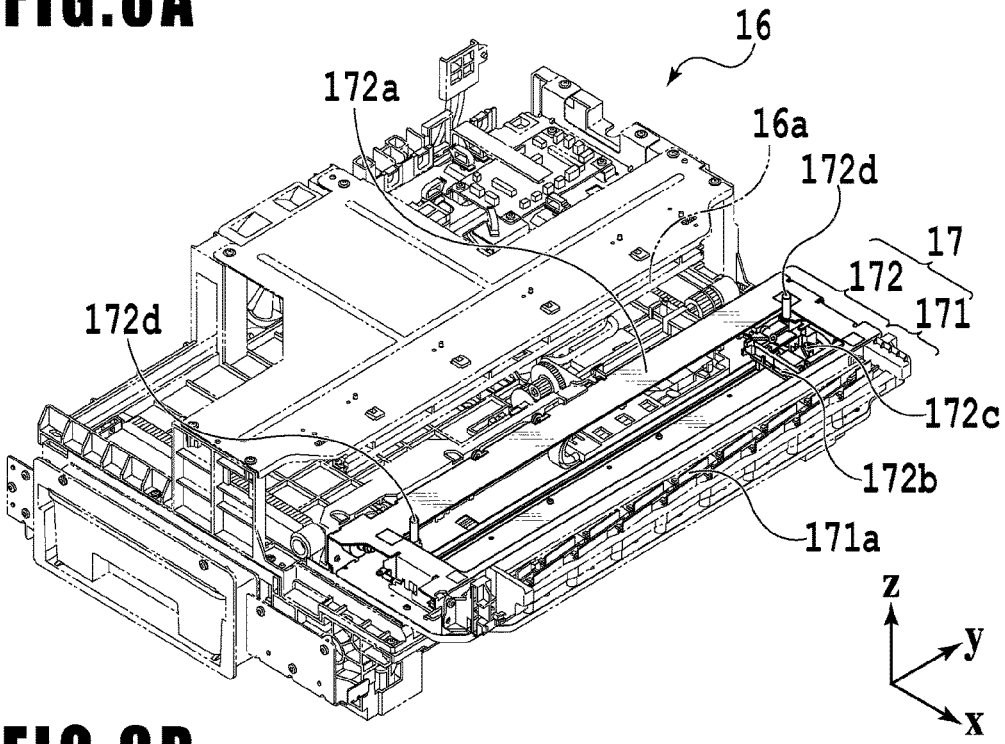

FIG. 8A is a perspective view illustrating the maintenance unit 16 at its standby position. FIG. 8B is a perspective view illustrating the maintenance unit 16 at its maintenance position. FIG. 8A corresponds to FIG. 1, and FIG. 8B corresponds to FIG. 7. When the printing head 8 is at its standby position, the maintenance unit 16 is at its standby position illustrated in FIG. 8A and therefore the cap unit 10 is moved upward in the vertical direction and the wiping unit 17 is housed in the maintenance unit 16. The cap unit 10 includes the cap member 10*a*, which is in a box shape extending in the y direction. With this brought into tight contact with the ejection port surface 8*a* of the printing head 8, the cap unit 10 can reduce evaporation of the inks through the ejection ports. The cap unit 10 also has a function of collecting the inks ejected onto the cap member 10*a* for preliminary ejection or the like and sucking the collected inks with a suction pump not illustrated.

On the other hand, at the maintenance position illustrated in FIG. 8B, the cap unit 10 is moved downward in the vertical direction and the wiping unit 17 is pulled out of the maintenance unit 16. The wiping unit 17 includes two wiper units, namely a blade wiper unit 171 and a vacuum wiper unit 172.

In the blade wiper unit 171, blade wipers 171*a* that wipe the ejection port surface 8*a* in the x direction are disposed along the y direction over a length corresponding to the region along which the ejection ports are aligned. To perform a wiping operation using the blade wiper unit 171, the wiping unit 17 moves the blade wiper unit 171 in the x direction with the printing head 8 positioned at such a height level that the printing head 8 can contact the blade wipers 171*a*. With this movement, the blade wipers 171*a* wipe the inks and the like attached to the ejection port surface 8*a*.

At the inlet of the maintenance unit 16 through which the blade wipers 171*a* are housed, a wet wiper cleaner 16*a* is disposed which removes the inks attached to the blade wipers 171*a* and applies a wetting liquid to the blade wipers 171*a*. Each time the blade wipers 171*a* are housed into the maintenance unit 16, the matters attached to the blade wipers 171*a* are removed and the wetting liquid is applied thereto by the wet wiper cleaner 16*a*. Then, the next time the blade wipers 171*a* wipe the ejection port surface 8*a*, the wetting liquid is transferred onto the ejection port surface 8*a*, thereby improving the lubricity between the ejection port surface 8*a* and the blade wipers 171*a*.

On the other hand, the vacuum wiper unit 172 includes a flat plate 172*a* with an opening portion extending in the y direction, a carriage 172*b* capable of moving in the y direction within the opening portion, and a vacuum wiper 172*c* mounted on the carriage 172*b*. The vacuum wiper 172*c* is disposed so as to be capable of wiping the ejection port surface 8*a* in the y direction with movement of the carriage 172*b*. At the tip of the vacuum wiper 172*c*, a suction port is formed which is connected to a suction pump not illustrated. Thus, by moving the carriage 172*b* in the y direction with the suction pump actuated, the inks and the like attached to the ejection port surface 8*a* of the printing head 8 are wiped by the vacuum wiper 172*c* and sucked into the suction port. In this operation, the flat plate 172*a* and positioning pins 172*d* provided at opposite ends of its opening portion are used to position the ejection port surface 8*a* relative to the vacuum wiper 172*c*.

In this embodiment, it is possible to perform a first wiping process in which the wiping operation by the blade wiper unit 171 is performed but the wiping operation by the vacuum wiper unit 172 is not performed and a second wiping process in which both wiping processes are sequentially performed. To perform the first wiping process, the print controller 202 first pulls the wiping unit 17 out of the maintenance unit 16 with the printing head 8 retreated to above the maintenance position in FIG. 7 in the vertical direction. The print controller 202 then moves the printing head 8 downward in the vertical direction to such a position that the printing head 8 can contact the blade wipers 171*a*, and thereafter moves the wiping unit 17 to the inside of the maintenance unit 16. With this movement, the blade wipers 171*a* wipe the inks and the like attached to the ejection port surface 8*a*. Specifically, the blade wipers 171*a* wipe the ejection port surface 8*a* as they are moved from the position to which the wiping unit 17 has been pulled out of the maintenance unit 16 to the inside of the maintenance unit 16.

After housing the blade wiper unit 171, the print controller 202 moves the cap unit 10 upward in the vertical direction to thereby bring the cap member 10*a* into tight contact with the ejection port surface 8*a* of the printing head 8. The print controller 202 then drives the printing head 8 in this state to cause it to perform preliminary ejection, and sucks the inks collected in the cap member 10*a* with the suction pump.

On the other hand, to perform the second wiping process, the print controller 202 first slides the wiping unit 17 to pull it out of the maintenance unit 16 with the printing head 8 retreated to above the maintenance position in FIG. 7 in the vertical direction. The print controller 202 then moves the printing head 8 downward in the vertical direction to such a position that the printing head 8 can contact the blade wipers 171*a*, and thereafter moves the wiping unit 17 to the inside of the maintenance unit 16. As a result, the wiping operation by the blade wipers 171*a* is performed on the ejection port surface 8*a*. Subsequently, the print controller 202 slides the wiping unit 17 to pull it out of the maintenance unit 16 to a predetermined position with the printing head 8 retreated to above the maintenance position in FIG. 7 in the vertical direction again. The print controller 202 then positions the ejection port surface 8*a* and the vacuum wiper unit 172 relative to each other by using the flat plate 172*a* and the positioning pins 172*d* while lowering the printing head 8 to the wiping position illustrated in FIG. 7. The print controller 202 thereafter performs the above-described wiping operation by the vacuum wiper unit 172. The print controller 202 retreats the printing head 8 upward in the vertical direction and houses the wiping unit 17, and then performs preliminary ejection into the cap member and the operation of sucking the collected inks with the cap unit 10, as in the first wiping process.

Next, details of the configuration of the vacuum wiper unit 172 and details of the wiping operation by the vacuum wiper unit 172 in this embodiment will be described.

The wiping operation using the vacuum wiper unit 172 (hereinafter, referred to as "vacuum wiping" as appropriate) is performed after the wiping operation by the blade wiper unit 171 in the second wiping process, as described above. This vacuum wiping (i.e. the second wiping process) is performed when a print operation on a print medium S is performed a predetermined number of times, when the first wiping process is performed a predetermined number of times, when the user inputs an instruction to perform the vacuum wiping, and other similar cases.

Figure 9A:
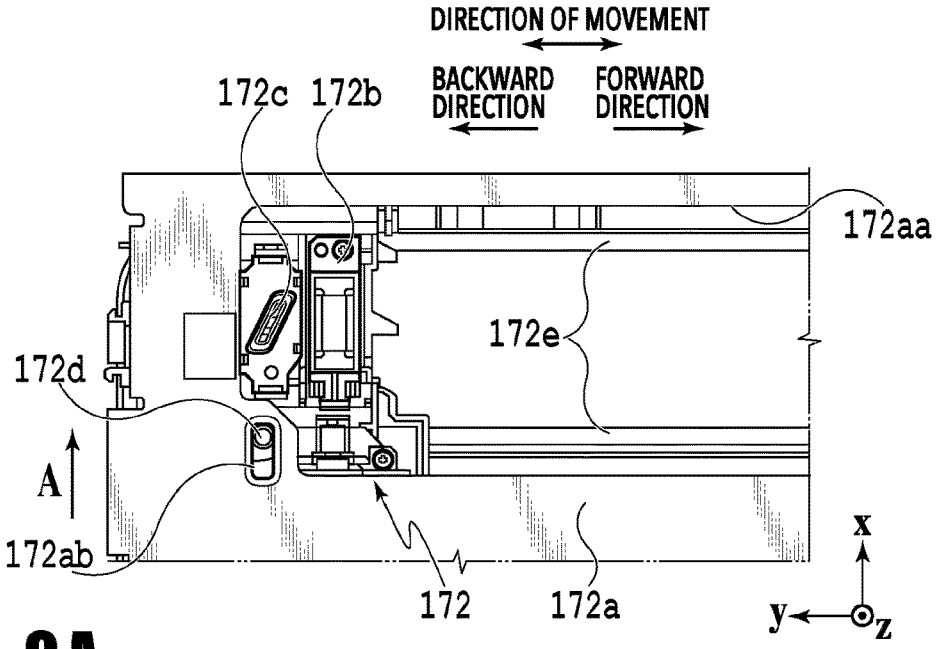
FIG. 9A and FIG. 9B are explanatory views explaining positioning relative to a printing head by means of positioning pins.
Figure 9B:
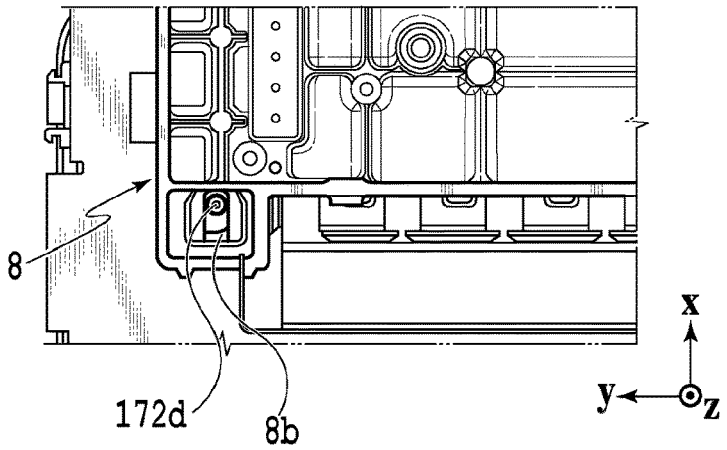
Figure 9C:
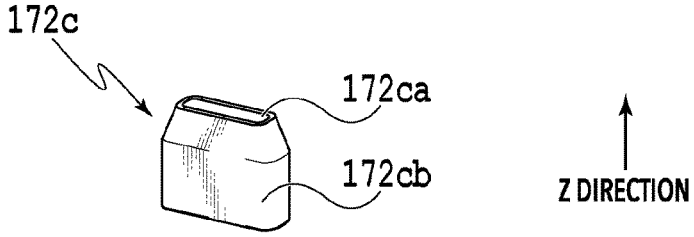
FIG. 9C is a schematic structural view of a vacuum wiper.

FIG. 9A is a partially enlarged view around the carriage, located at one end of an opening portion 172*aa* of the flat plate 172*a*. FIG. 9B is an explanatory view illustrating a state where the positioning pins and hole portions of the printing head are fitted to each other. FIG. 9C is a schematic structural view of the vacuum wiper.

In the vacuum wiper unit 172, the carriage 172*b* is slidably provided on a pair of guide rails 172*e* extending in the y direction (first direction), as illustrated in FIG. 9A. Further, the carriage 172*b* is moved forward and backward in the y direction by a driver (not illustrated) such as a motor that is driven based on control by the print controller 202. Specifically, the carriage 172*b* is moved in a forward direction from one end of the opening portion 172*aa* of the flat plate 172*a* toward the opposite end and also moved in a backward direction from the opposite end toward the one end. Meanwhile, the carriage 172*b* is located at the one end, as illustrated in FIG. 8B, while the vacuum wiping is not performed. Accordingly, the vacuum wiper 172*c*, mounted on the carriage 172*b*, is configured to be movable forward and backward in the y direction with the carriage 172*b*. In this embodiment, the vacuum wiping is performed only while the vacuum wiper 172*c* is moved in the forward direction with the carriage 172*b*.

As illustrated in FIG. 9C, the vacuum wiper 172*c* (suction unit) includes a suction port 172*ca* and a wiper portion 172*cb*. The wiper portion 172*cb* is made of, for example, a material that does not or is unlikely to damage the ejection port surface 8*a* of the printing head 8 and later-described ejection units 81 provided in the ejection port surface 8*a* even when moving in contact with the ejection port surface 8*a*, such as an elastic material. For example, the wiper portion 172*cb* is made of an elastic material such as rubber. Also, the wiper portion 172*cb* is formed in a substantially tubular shape, and the suction port 172*ca* is located at its upper end (tip). The suction port 172*ca* is in a substantially rectangular shape with the short sides (shorter edges) of the rectangle formed in an arched shape, for example. The suction pump (not illustrated), driven based on control by the print controller 202, is connected to the lower end of the wiper portion 172*cb* and configured to be capable of lowering the pressure of the space inside the wiper portion 172*cb*. In this way, the vacuum wiper 172*c* is configured to be capable of sucking a region which the suction port 172*ca* contacts. Also, the wiper portion 172*cb* has a predetermined length in the z direction. In this way, the tip of the wiper portion 172*cb* contacts the ejection port surface 8*a* at a predetermined pressure when the printing head 8 is lowered to the wiping position illustrated in FIG. 7 to perform the vacuum wiping.

Also, in the vacuum wiper unit 172, as illustrated in FIG. 8B, the positioning pins 172*d* (positioning part) are provided near the opposite ends of the opening portion 172*aa* of the flat plate 172*a*. Note that the two the positioning pins 172*d* have the same configuration and position the vacuum wiper unit 172 and the printing head 8 relative to each other by acting in the same way on the printing head 8. For this reason, in the following description, the configuration of the positioning pin 172*d* located at one end of the opening portion 172*aa* and its operation will be described in detail, and detailed description of the positioning pin 172*d* located at the opposite end will be omitted.

As illustrated in FIG. 9A, the positioning pin 172*d* is provided so as to be movable in the x direction (second direction) within an elongated hole 172*ab* in the flat plate 172*a* extending in the x direction. Here, the positioning pin 172*d* projects from the top of the flat plate 172*a* by a predetermined length. Also, the positioning pin 172*d* is biased by a biasing member (not illustrated) in the direction of arrow A along the x direction (in this embodiment, a direction from the bottom toward the top of FIG. 9A). Moreover, the printing head 8 includes a hole portion 8*b* (fitting part) into which the portion of the positioning pin 172*d* projecting from the top of the flat plate 172*a* can be fitted (see FIG. 9B) when the printing head 8 is lowered to the wiping position illustrated in FIG. 7. As the positioning pin 172*d* is fitted in the hole portion 8*b*, the vacuum wiper unit 172 is positioned relative to the printing head 8 in the x direction with the positioning pin 172*d* contacting positioning surfaces of the hole portion 8*b* on its shorter edges. In other words, the vacuum wiper 172*c* and the ejection units 81 are positioned relative to each other.

Figure 10:
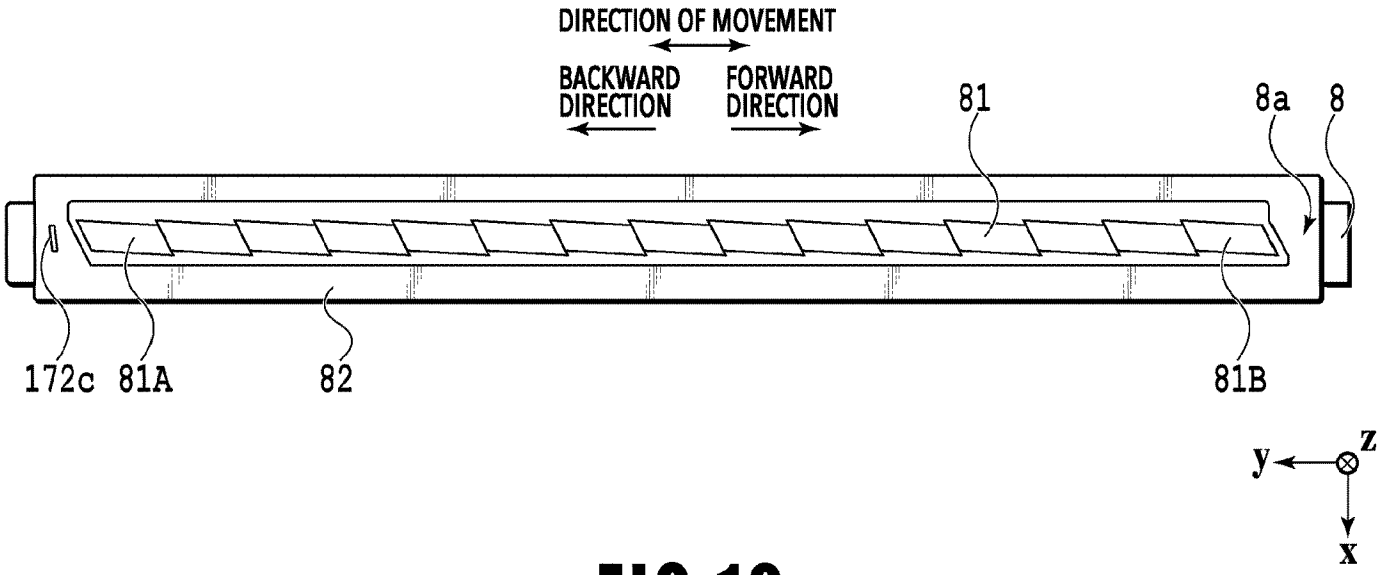
FIG. 10 is an explanatory view illustrating the positional relationship between the vacuum wiper and ejection units.

FIG. 10 is a view illustrating the ejection port surface 8*a* of the printing head 8 at the wiping position illustrated in FIG. 7 and the vacuum wiper 172*c*. FIG. 10 illustrates a state as viewed from the bottoms of the printing head 8 and the vacuum wiper unit 172. Note that for the vacuum wiper unit 172, only the vacuum wiper 172*c* is illustrated and illustration of its other members is omitted in order to facilitate understanding.

Here, a plurality of ejection units 81 having the same dimensions and configuration are provided in the ejection port surface 8*a* of the printing head 8 along the y direction. In this embodiment, each of the ejection units 81 is a semiconductor chip in which ejection ports are formed. Moreover, in the vacuum wiping, a cleaning process is performed with the vacuum wiper 172*c* moved with the carriage 172*b* from the left side toward the right side in FIG. 10 by driving the driver not illustrated. Specifically, a cleaning process such as a suction recovery process of forcibly sucking the inks from the ejection ports of the ejection units 81, provided in the ejection port surface 8*a*, and a wiping process of wiping and sucking the inks and dust attached to the ejection units 81 is performed.

Figure 11:
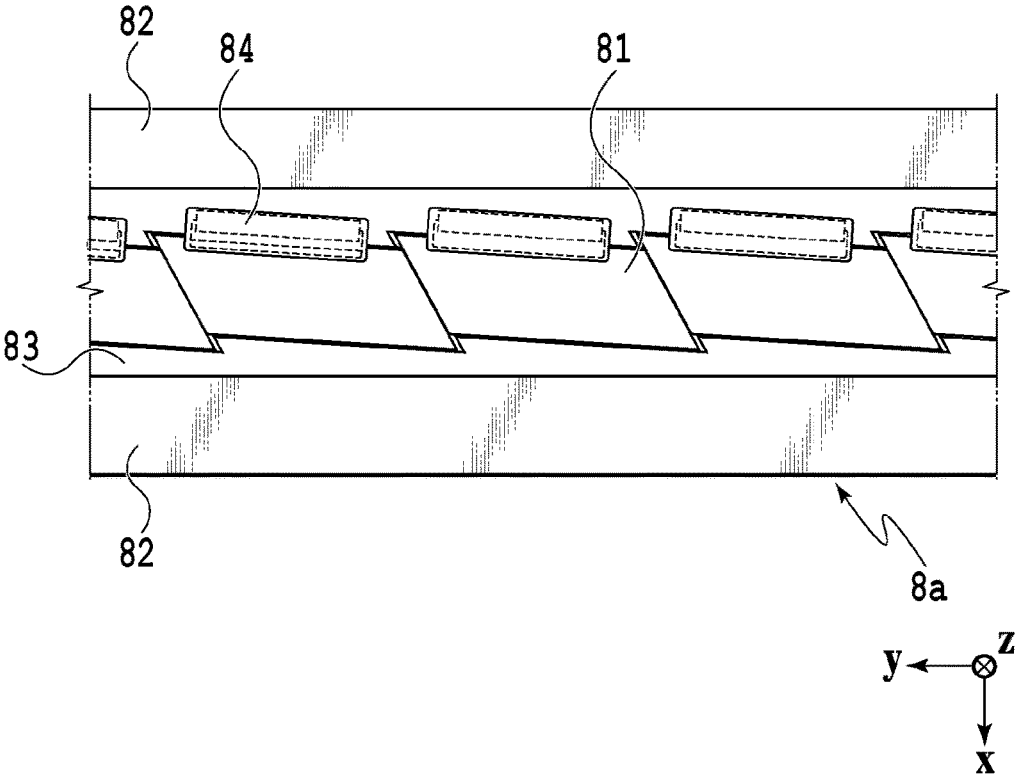
FIG. 11 is an enlarged view of a part of FIG. 10.
Figure 12:
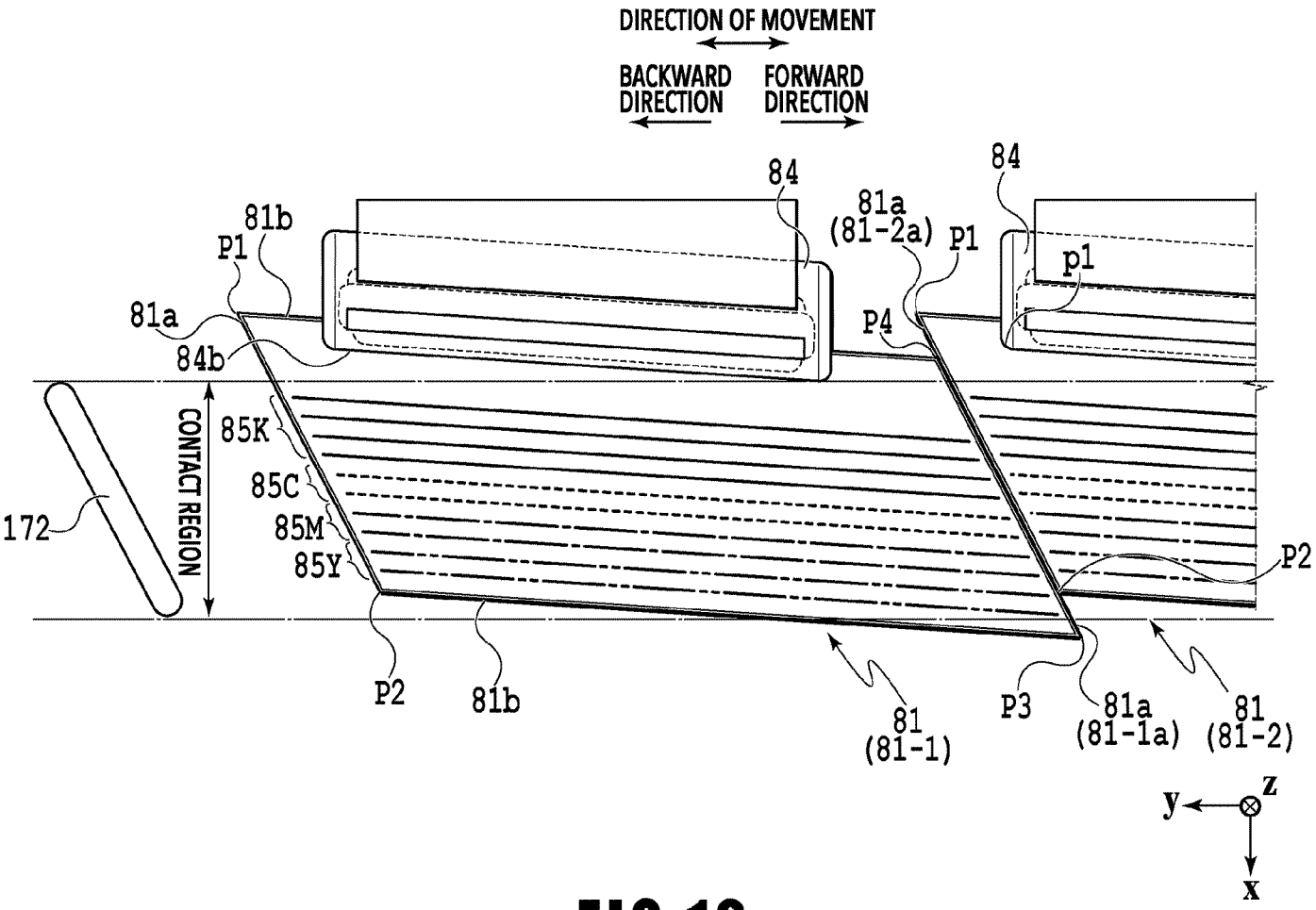
FIG. 12 is an enlarged view of some ejection units.

Next, a contact region within which the vacuum wiper 172*c* contacts the ejection port surface 8*a* during the vacuum wiping will be described. Note that in the following description, the contact region within which the vacuum wiper 172*c* contacts the ejection port surface 8*a* during the vacuum wiping will be referred to as "the contact region of the vacuum wiper 172*c*" or simply "the contact region" as appropriate. Also, in this description, the contact region includes a suction region sucked by the suction port 172*ca*, and the suction region in the contact region covers all ejection ports. FIG. 11 illustrates a partially enlarged view of FIG. 10, and FIG. 12 illustrates an enlarged view of some ejection units.

The ejection port surface 8*a* of the printing head 8 is provided with the ejection units 81, a frame portion 82, a sealing portion 83, and wiring sealing portions 84. In each of the ejection units 81, a plurality of ejection port arrays are formed in each of which a plurality of ejection ports for ejecting an ink are aligned, as illustrated in FIG. 12. Specifically, ejection port arrays 85K, 85C, 85M, and 85Y for colors of black, cyan, magenta, and yellow are formed substantially in parallel to longer edges 81*b* of the ejection unit 81. Wirings are connected to each ejection unit 81, and a wiring sealing portion 84 that seals these wirings is provided. This wiring sealing portion 84 is formed at one longer edge 81*b* of the ejection unit 81, and longer edges 84*b* of the wiring sealing portion 84 are substantially parallel to the longer edge 81*b* of the ejection unit 81.

Meanwhile, each ejection unit 81 is formed in a parallelogram shape and tilted at a predetermined angle with respect to the y direction, and the adjacent ejection units 81 are aligned along the y direction with their end edges (shorter edges) 81*a* disposed next to each other. In other words, at the ejection port surface 8*a* of the printing head 8, the ejection units 81 are disposed tilted with respect to a direction (y direction) perpendicular to the direction of transport of a print medium S (x direction). Here, the ejection port arrays are also tilted at the predetermined angle with respect to the y direction, and the ejection port arrays of the adjacent ejection units 81 for ejecting the ink of the same color overlap with each other in the y direction. In other words, focusing on any two adjacent ejection units, ejection ports located around ends of the ejection port arrays of one of the ejection units 81 (the ends on the side where the other ejection unit 81 is located) and ejection ports located around ends of the ejection port arrays of the other ejection unit 81 (the ends on the side where the one ejection unit 81 is located) overlap with each other when viewed from the x direction. Note that in the case where a plurality of ejection port arrays for ejecting an ink of the same color are formed in each ejection unit 81, ejection ports in at least one of the ejection port arrays for ejecting the ink of the same color overlap. Also, the end edges 81*a* of the ejection unit 81 are the edges crossing the direction of extension of the ejection port arrays in the ejection unit 81.

Here, during the vacuum wiping, the vacuum wiper 172*c* moves over the ejection units 81 in the y direction in contact with the ejection units 81. As described above, the parallelogram ejection units 81 are disposed tilted with respect to the y direction. Hence, a corner portion P1 with an acute angle and a corner portion P2 with an obtuse angle are located on the upstream side of each ejection unit 81 in the direction of movement of the vacuum wiper 172*c* (forward direction) in the vacuum wiping.

The corner portion P2 of every ejection unit 81 except an ejection unit 81A at the most upstream position in the forward direction is in contact with or in vicinity of the end edge 81*a* of the adjacent ejection unit 81. Thus, when the vacuum wiper 172*c* contacts the corner portion P2 of each ejection unit 81 except the ejection unit 81A, the reaction is less unlikely to concentrate at the contact point with the corner portion P2. On the other hand, the corner portion P1 of each ejection unit 81 is not in contact with or in vicinity of the end edge 81*a* of the adjacent ejection unit 81. If the contact region of the vacuum wiper 172*c* covers the whole ejection units 81 in the x direction, then, each time the vacuum wiper 172*c* contacts an ejection unit in the vacuum wiping, the vacuum wiper 172*c* will contact it from its corner portion P1. Consequently, the reaction will concentrate on the contact point of the vacuum wiper 172*c* with the corner portion P1.

To avoid this, in this embodiment, the contact region of the vacuum wiper 172*c* is set as below. Specifically, the contact region is set to cover all ejection ports in the ejection port arrays of each ejection unit 81. Further, for each ejection unit 81, the contact region is set not to cover a corner portion among the two corner portions of the downstream ejection unit 81 located at the opposite ends of its upstream end edge 81*a*, the corner portion not overlapping with the downstream end edge 81*a* of the upstream ejection unit 81 in the x direction. In other words, focusing on any two adjacent ejection units, the contact region is set not to cover the corner portion among the above two corner portions that is present at a position not overlapping with the downstream end edge 81*a* of the upstream ejection unit 81 when viewed from the forward direction (y direction). Note that "upstream" and "downstream" refer to the upstream side in the forward direction (direction of movement of the vacuum wiper 172*c*) and the downstream side in the forward direction, respectively.

Note that this setting of the contact region in the x direction is not determined based on two ejection units 81 located at particular positions among the plurality of ejection units 81 aligned in the y direction. Specifically, each ejection unit 81 is aligned with the same configuration and the same tilt angle. Hence, by setting the contact region in the x direction based on any two adjacent ejection units 81 among all ejection units 81, the contact region is shaped by all ejection units 81.

Specifically, focus on the two corner portions P1 and P2 located at the opposite ends of an upstream end edge 81-2*a* (second end edge) of an ejection unit 81-2 (second ejection unit) located on the downstream side in the forward direction among two adjacent ejection units 81-1 and 81-2 as illustrated in FIG. 12. The corner portion P2 overlaps in the x direction with a downstream end edge 81-1*a* (first end edge) of the ejection unit 81-1 (first ejection unit), which is located on the upstream side in the forward direction. On the other hand, the corner portion P1 does not overlap in the x direction with the end edge 81-1*a* of the ejection unit 81-1 on the downstream side in the forward direction. Thus, the contact region is set not to cover the corner portion P1. Specifically, in the x direction, the contact region is adjusted to exclude the corner portion P1 from the contact region. Meanwhile, in the y direction, the contact region may just need to be adjusted to cover all ejection ports in the ejection port arrays of each ejection unit 81. Specifically, for example, the contact region is adjusted to cover at least the upstream end edge 81*a* of the ejection unit 81A at the most upstream position in the forward direction and the downstream end edge 81*a* of an ejection unit 81B at the most downstream position in the forward direction.

One side of this contact region in the x direction is preferably located between the closest ejection port array of each ejection unit 81 to one side and the closer longer edge 81*b* or closest corner portion of the ejection unit 81 to the one side, for example. Moreover, the opposite side in the x direction is preferably located between the closest ejection port array of each ejection unit 81 to the opposite side and the closer longer edge 81*b* or closest corner portion of the ejection unit 81 to the opposite side. Specifically, as illustrated in FIG. 12, the end of the contact region on the one side in the x direction is located between the longer edge 81*b* and the ejection port array 85K, while the end on the opposite side is located is located between a corner portion P3 and the ejection port array 85Y. Note that the corner portion P3 is the corner portion of the ejection unit 81 with an acute angle located the closest to the opposite side in the x direction.

A case of performing the vacuum wiping of the vacuum wiper unit 172 with the above configuration will be described. First, after the wiping operation by the blade wipers 171*a* is finished in the second wiping process, the print controller 202 retreats the printing head 8 to above the wiping position in FIG. 7 in the vertical direction, and slides and pulls the wiping unit 17 out of the maintenance unit 16 to a predetermined position. The print controller 202 then lowers the printing head 8 to the wiping position illustrated in FIG. 7. At this moment, the positioning pins 172*d* of the vacuum wiper unit 172 are fitted into the hole portions 8*b* of the printing head 8, thereby positioning the vacuum wiper unit 172 relative to the printing head 8 in the x direction. Also, the tip of the vacuum wiper 172*c* comes into contact with the ejection port surface 8*a* (frame portion 82) of the printing head 8 lowered to the wiping position.

Then, the print controller 202 performs the cleaning process by driving the carriage 172*b* to make the vacuum wiper 172*c* move in the forward direction in contact with the ejection port surface 8*a* while also driving the suction pump. At this moment, the vacuum wiper 172*c* contacts the corner portion P2, which overlaps with the downstream end edge 81*a* of each ejection unit 81 in the x direction, but does not contact the corner portion P1, which does not overlap with the end edge 81*a* in the x direction. Thus, during the vacuum wiping, the vacuum wiper 172*c* contacts each ejection unit 81 but the reaction does not concentrate at a particular one spot on the vacuum wiper 172*c*. This reduces damage to the wiper portion 172*cb*.

Figure 13:
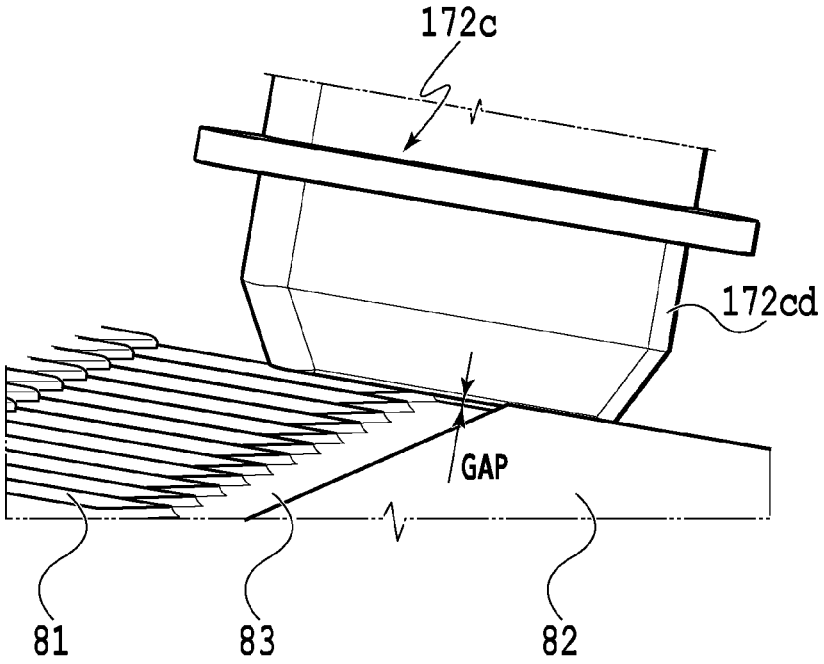
FIG. 13 is an explanatory view illustrating a state where the vacuum wiper is in contact with an ejection unit and a frame portion.

Here, the sealing portion 83 is shaped to be recessed from each ejection unit 81 and the frame portion 82. Thus, if the vacuum wiper 172*c* simultaneously contacts the ejection unit 81 and the frame portion 82, the wiper portion 172*cb* cannot follow the recessed shape of the sealing portion 83 and thereby generates a gap, as illustrated in FIG. 13. This decreases the suction power. However, one side of the contact region of the vacuum wiper 172*c* in the x direction is located between the longer edge 81*b* (wiring sealing portion 84) and the ejection port array 85K while the opposite side is located between the corner portion P3 and the ejection port array 85Y. Hence, the vacuum wiper 172*c* does not simultaneously contact the ejection unit 81 and the frame portion 82. This can prevent decrease in suction power.

After the vacuum wiping is thus finished, the print controller 202 retreats the printing head 8 upward in the vertical direction, so that the hole portions 8*b* and the positioning pins 172*d* in the fitted state are disengaged. Then, when the vacuum wiper 172*c* becomes separated from the ejection port surface 8*a*, the print controller 202 moves the vacuum wiper 172*c* in the backward direction with the carriage 172*b* to place the vacuum wiper 172*c* at the one end of the opening portion 172*aa*.

As described above, for each ejection unit, the contact region is set not to cover a corner portion among the two corner portions of the ejection unit 81 on the downstream side in the forward direction on its upstream end edge 81*a*, the corner portion not overlapping with the downstream end edge 81*a* of the upstream ejection unit 81 in the x direction. In this way, when the vacuum wiper 172*c* contacts each ejection unit 81, the reaction does not concentrate at one particular spot on the vacuum wiper 172*c*. This reduces damage to the wiper portion 172*cb* and accordingly suppresses deterioration in durability of the vacuum wiper 172*c*.

Also, the end of the contact region on one side in the x direction is located between the closest ejection port array to the one side and the closer longer edge 81*b* or closest corner portion to the one side. Moreover, the end on the opposite side is located between the closest ejection port array to the opposite side and the closer longer edge 81*b* or closest corner portion to the opposite side. In this way, the vacuum wiper 172*c* does not simultaneously contact the ejection unit 81 and the frame portion 82 over the recessed sealing portion 83. This can prevent decrease in suction power.

Further, the vacuum wiper unit 172 is positioned relative to the printing head 8 by means of the positioning pins 172*d* and the hole portions 8*b* of the printing head 8. As a result, the vacuum wiper 172*c* is positioned relative to the ejection units 81 in the x direction. Hence, even when the vacuum wiper 172*c* is moved in the forward direction, the vacuum wiper 172*c* remains in the positioned state without being affected by this movement.

Other Embodiments

Note that the above embodiment may be modified as described in (1) to (6) below.

(1) In the above embodiment, the vacuum wiping is performed only during the forward movement of the vacuum wiper 172*c*. However, the present invention is not limited to this. Specifically, the vacuum wiping may be performed during the backward movement or during the forward movement and the backward movement.

Firstly, focus on the corner portions P3 and P4 located on the opposite sides of the upstream end edge 81*a* of the ejection unit 81-1, located on the downstream side in the backward direction, among the two adjacent ejection units 81-1 and 81-2 in the backward movement (see FIG. 12). The corner portion P4 overlaps in the x direction with the downstream end edge 81-2*a* of the ejection unit 81-2, located on the upstream side in the backward direction. On the other hand, the corner portion P3 does not overlap in the x direction with the end edge 81-2*a* of the ejection unit 81-2 on the downstream side in the backward direction.

Thus, to perform the vacuum wiping only during the backward movement, the contact region needs to be set not to cover the corner portion P3. Also, to perform the vacuum wiping during the forward movement and the backward movement, the contact region needs to be set to cover neither the corner portion P1 nor the corner portion P3.

(2) In the above embodiment, one side of the contact region in the x direction is located between the long side (longer edge) 81*b* and the ejection port array 85K, while the opposite side is located between the corner portion P3 and the ejection port array 85Y. However, the present invention is not limited to this. Specifically, the one side in the x direction may be at any position as long as it is located between the ejection port array 85K and the corner portion P2. Here, the wiring sealing portion 84 is formed in a rectangular shape. Although no particular consideration is taken in the above embodiment, the one side of the contact region in the x direction will be set to be located between the ejection port array 85K and a corner portion p1 of the wiring sealing portion 84 if the corner portion p1 is shaped such that, when it contacts the vacuum wiper 172*c*, the reaction concentrates at the contact point. Moreover, the opposite side in the x direction may be located on the sealing portion 83 side relative to the corner portion P3. Note that in this case, the position of the opposite side is set with decrease in suction power of the vacuum wiper 172*c* and so on taken into consideration.

Figure 14A:
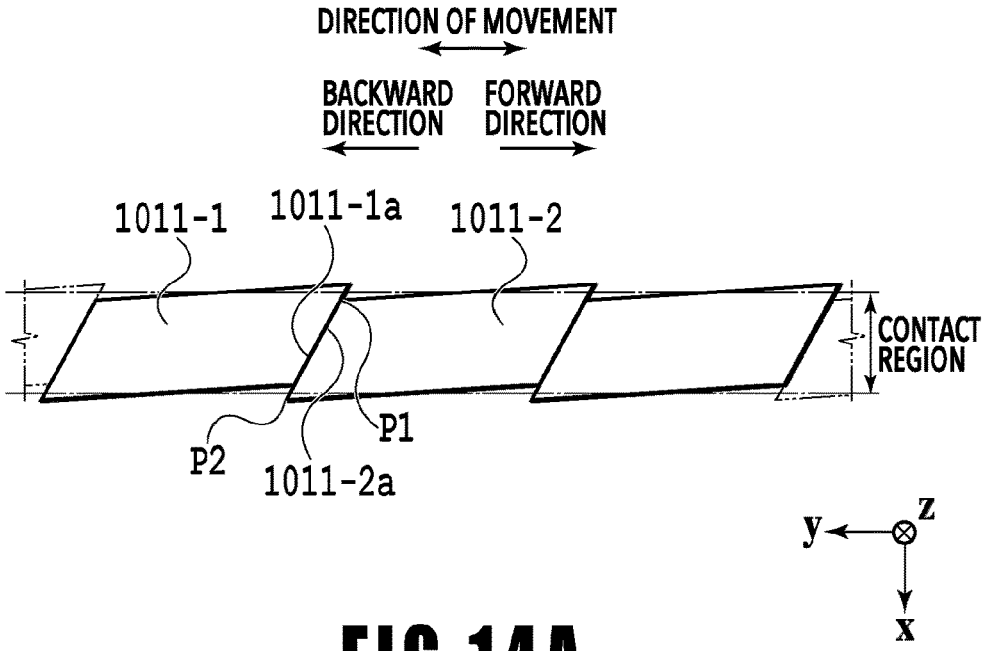
FIG. 14A and FIG. 14B are explanatory views illustrating modifications of the ejection units.

(3) In the above embodiment, the parallelogram ejection units 81 are tilted at a predetermined angle with respect to the y direction and aligned along the y direction. However, the present invention is not limited to this. Specifically, as illustrated in FIG. 14A, the arrangement of the ejection units 81 may be a lateral reversal of the arrangement of the ejection units 81 in FIG. 10. In this case, the contact region is set not to cover the corner portion P2, among the corner portions P1 and P2 located on an end edge 1011-2*a* of an ejection unit 1011-2 on the downstream side in the forward direction, which does not overlap with an end edge 1011*a* of an ejection unit 1011-1 on the upstream side in the forward direction.

Figure 14B:
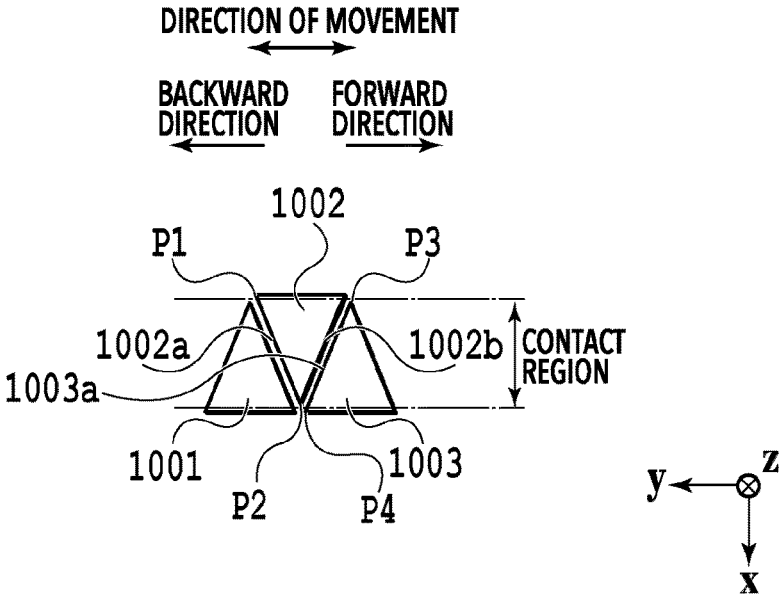

Also, as illustrated in FIG. 14B, ejection units formed in a triangular shape may be used such that the ejection units are aligned along the y direction with the adjacent ejection units upside down. In this case, for triangular ejection units 1001 and 1002, the contact region is set not to cover the corner portion P1, among the corner portions P1 and P2 located on an end edge 1002*a* of the ejection unit 1002, which does not overlap with an end edge 1001*b* of the ejection unit 1001 in the x direction. Moreover, for the triangular ejection unit 1002 and a triangular ejection unit 1003, the contact region is set not to cover the cover portion P4, among the corner portions P3 and P4 located on an end edge 1003*a* of the ejection unit 1003, which does not overlap with an end edge 1002*b* of the ejection unit 1002 in the x direction.

(4) Although not particularly described in the above embodiment, the tilt angle of the vacuum wiper 172*c* with respect to the y direction is determined in accordance with the tilt angle of the end edges 81*a* of the ejection units 81 with respect to the y direction.

Here, the wiring sealing portion 84 are formed on the longer edges 81*b* of the ejection units 81, and the sealing portion 83 is shaped to be recessed from the ejection unit 81 and the frame portion 82. Moreover, in the vacuum wiping, the vacuum wiper 172*c* moves over the frame portion 82 and the sealing portion 83 and then contacts the ejection unit 81A. Here, the two corner portions of the ejection unit 81A located on the upstream side in the forward direction, which is the direction of movement of the vacuum wiper 172*c*, are in an uncovered state. Meanwhile, the contact region does not cover the corner portions P1 of the ejection units 81 but covers their corner portions P2.

Figure 15B:
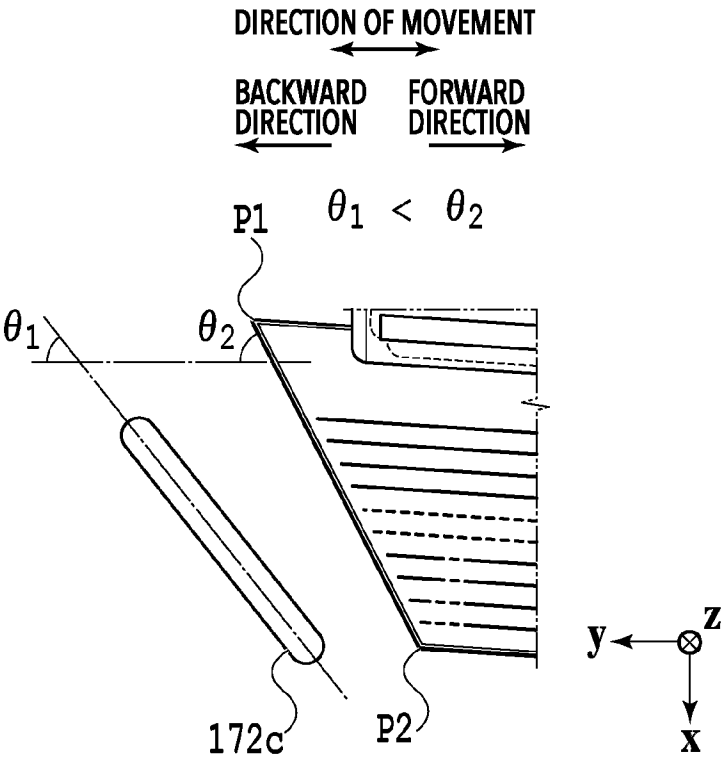
FIG. 15A and FIG. 15B are explanatory views illustrating the tilt angle of the vacuum wiper with respect to the end edges of the ejection units.
Figure 15A:
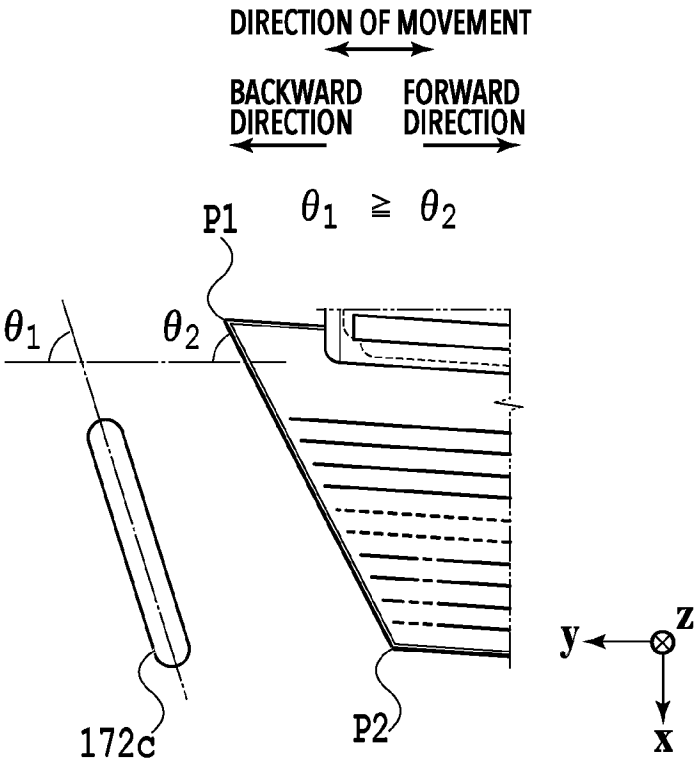

Thus, if, for example, a tilt angle θ2 of the end edges 81*a* of the ejection units 81 is larger than a tilt angle θ1 of the vacuum wiper 172*c*, as illustrated in FIG. 15B, the vacuum wiper 172*c* will contact each ejection unit 81 from its corner portion P2, so that the reaction will concentrate at the contact point with the corner portion P2. To avoid this, as illustrated in FIG. 15A, the tilt angle θ1 of the vacuum wiper 172*c* is set to be larger than or equal to the tilt angle θ2 of each end edge 81*a*. In this way, the vacuum wiper 172*c* will contact each ejection unit 81 from its end edge 81*a* and therefore the reaction will not concentrate at one particular spot on the vacuum wiper 172*c*. Thus, the vacuum wiper 172*c* will neither contact the ejection unit 81A from its corner portion. This ensures reduction of damage to the wiper portion 172*cb* and allows greater suppression of deterioration in durability of the vacuum wiper 172*c*. Note that the tilt angles 81 and 82 are tilt angles with respect to they direction.

(5) In the above embodiment, the configuration is such that the printing head 8 performs printing on a print medium S transported in the x direction. However, the present invention is not limited to this. Specifically, the printing head may be configured to be movable in the x direction and the recording head performs printing on a print medium that is stopped being transported. Also, in the printing apparatus 1, the vacuum wiper 172*c* is moved relative to the printing head 8 in the y direction. However, the present invention is not limited to this. Specifically, the printing head 8 may be moved relative to the vacuum wiper 172*c* in the y direction. In other words, the printing head 8 and the vacuum wiper 172*c* may just be configured to be movable relative to each other in the y direction.

(6) In the above embodiment, the vacuum wiper 172*c* is positioned relative to the ejection unit 81 in the x direction by means of the positioning pins 172*d* and the hole portions 8*b*. However, the present invention is not limited to this. Specifically, any configuration may be employed as long as the vacuum wiper 172*c* can remain in a positioned state relative to the ejection unit 81 in the x direction without being affected by the movement of the vacuum wiper 172*c* during the vacuum wiping. For example, engagement portions such as grooves, recesses, or protrusions engageable with the positioning pins 172*d* may be provided to the printing head 8.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133656 filed Jul. 7, 2017, which is hereby incorporated by reference wherein in its entirety.

What is claimed is:

1. An inkjet printing apparatus comprising:

a printing head provided with a first ejection unit and a second ejection unit, in each of which a plurality of ejection port arrays are formed, with a plurality of ejection ports for ejecting an ink being aligned in each of the plurality of ejection port arrays, the first and second ejection units being provided along a first direction with end edges thereof disposed next to each other; and a suction unit capable of contacting the first and the second ejection units and sucking the first and the second ejection units while moving relative to the first and the second ejection units in the first direction, wherein, when the suction unit moves in the first direction, after having sucked ink from the first ejection unit, the suction unit sucks ink from the second ejection unit, and where the suction unit is in contact with a corner portion of the second ejection unit overlapping an end edge of the first ejection unit at a downstream side in the direction of movement, and is not in contact with a corner portion of the second ejection unit not overlapping the end edge of the first ejection unit at the downstream side in the direction of movement, when viewed from the direction of movement.

2. The inkjet printing apparatus according to claim 1, further comprising a positioning part biased in a second direction perpendicular to the first direction, wherein the positioning part positions the suction unit relative to the first and second ejection units in the second direction while contacting the printing head.

3. The inkjet printing apparatus according to claim 2, wherein the positioning part is fitted to a fitting part of the printing head.

4. The inkjet printing apparatus according to claim 1, wherein a contact region is a region in which the suction unit is in contact with each of the first and the second ejection units, and wherein for each of the first and the second ejection units, one side of the contact region in a second direction perpendicular to the first direction is located between the closest ejection port array to one side within the first and the second ejection units and a closest edge or corner portion of the first and the second ejection units to the one side, and an opposite side of the contact region in the second direction is located between the closest ejection port array to an opposite side within the first and the second ejection units and a closest edge or corner portion of the first and second ejection units to the opposite side.

5. The inkjet printing apparatus according to claim 1, wherein the first and the second ejection unit has a parallelogram shape and is disposed tilted at a predetermined angle with respect to the first direction.

6. The inkjet printing apparatus according to claim 5, wherein each of the first and the second ejection units includes a wiring sealing portion sealing a wiring, and a side of the wiring sealing portion in a contact region is located between the closest ejection port array to the side and a corner portion of the wiring sealing portion on a most upstream side in the direction of movement, the contact region being where the suction unit is in contact with each of the first and the second ejection units.

7. The inkjet printing apparatus according to claim 1, wherein a tilt angle of the suction unit with respect to the first direction is determined in accordance with a tilt angle of the end edge of each of the first and the second ejection units with respect to the first direction such that the suction unit moving in the direction of movement contacts the ejection unit from the end edge.

8. The inkjet printing apparatus according to claim 1, wherein a contact region in which the suction unit is in contact with each of the first and the second ejection units covers all the ejection ports in the ejection port arrays of each of the ejection units.

* * * * *